US008274504B2

(12) United States Patent
Tsuchi

(10) Patent No.: US 8,274,504 B2
(45) Date of Patent: Sep. 25, 2012

(54) OUTPUT AMPLIFIER CIRCUIT AND DATA DRIVER OF DISPLAY DEVICE USING THE SAME

(75) Inventor: Hiroshi Tsuchi, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 849 days.

(21) Appl. No.: 12/385,080

(22) Filed: Mar. 30, 2009

(65) Prior Publication Data

US 2009/0244056 A1 Oct. 1, 2009

(30) Foreign Application Priority Data

Mar. 31, 2008 (JP) ..... 2008-091751

(51) Int. Cl.
*G09G 5/00* (2006.01)

(52) U.S. Cl. ..... 345/214

(58) Field of Classification Search ..... None
See application file for complete search history.

(56) References Cited

U.S. PATENT DOCUMENTS

| | | | | |
|---|---|---|---|---|
| 4,479,095 | A * | 10/1984 | Seiler | 330/261 |
| 5,311,145 | A | 5/1994 | Huijsing et al. | |
| 6,169,453 | B1 * | 1/2001 | Milanesi et al. | 330/258 |
| 6,586,990 | B2 | 7/2003 | Udo et al. | |
| 6,690,149 | B2 * | 2/2004 | Monomoushi et al. | 323/297 |
| 2003/0034833 | A1 | 2/2003 | Udo et al. | |
| 2005/0068105 | A1 | 3/2005 | Shimatani | |
| 2005/0206642 | A1 * | 9/2005 | Kushima et al. | 345/211 |
| 2006/0091955 | A1 * | 5/2006 | Choi | 330/260 |
| 2007/0030070 | A1 * | 2/2007 | Brueske et al. | 330/260 |
| 2007/0035534 | A1 | 2/2007 | Yamazaki | |
| 2007/0126722 | A1 * | 6/2007 | Hashimoto | 345/204 |
| 2009/0115507 | A1 * | 5/2009 | Cho | 330/9 |
| 2009/0201237 | A1 * | 8/2009 | Nishimura | 345/87 |
| 2009/0244056 | A1 * | 10/2009 | Tsuchi | 345/214 |

FOREIGN PATENT DOCUMENTS

| | | |
|---|---|---|
| JP | 6-326529 | 11/1994 |
| JP | 2003-60453 | 2/2003 |
| JP | 2005-124120 | 5/2005 |
| JP | 2007-47342 | 2/2007 |
| JP | 2007-156235 | 6/2007 |

* cited by examiner

*Primary Examiner* — Peter Vincent Agustin
(74) *Attorney, Agent, or Firm* — McGinn IP Law Group, PLLC

(57) ABSTRACT

Disclosed is an output amplifier circuit including a differential stage, a first output stage that receives outputs of the differential stage, and a second output stage having an output thereof electrically connected to a load. The differential stage receives an input signal at a non-inverting input thereof. In the first connection configuration, an output of the first output stage is electrically disconnected from the output of the second output stage, outputs of the differential stage are electrically disconnected from inputs of the second output stage, and a second input of the differential stage is electrically connected to the output of the first output stage. In the second connection configuration, the output of the first output stage is electrically connected to the output of the second output stage, and the outputs of the differential stage is electrically connected to the inputs of the second output stage.

30 Claims, 19 Drawing Sheets

POSITIVE-POLARITY SIGNAL
Vin1
10A
300
SW31
SW32
1A
NEGATIVE-POLARITY SIGNAL
Vin2
10B
SW33
SW34
1B
SW CONTROL SIGNAL
CONTROL SIGNAL GENERATION CIRCUIT
500
701
702
VDD
VSS
M1
M2
M3
M4
SW10
SW11
SW12
SW13
SW14
2
4
5
6
7
100
3A
3B
90A
90B
load POSITIVE-POLARITY SIGNAL
Vin1
1A
NEGATIVE-POLARITY SIGNAL
Vin2
1B
SW CONTROL SIGNAL
500
100A
100B
703
704
VDD
VSS
M1A
M2A
M3A
M4A
M1B
M2B
M3B
M4B
SW13A
SW14A
SW13B
SW14B
4A
2A
6A
5A
7A
3A
4B
2B
6B
5B
7B
3B
90A
90B
load
400-1
400-2
400-3
SW41
SW42
SW43
SW44
SW51
SW52
SW53
SW54
SW61
SW62
SW63
SW64

| | OFFSET CANCEL PERIOD | AMPLIFIER OPERATION PERIOD |
|---|---|---|
| SW4 | OFF | ON |
| M13、M15 | ON | OFF |
| M14、M16 | OFF | ON |
| SECOND OUTPUT STAGE | ACTIVATED | DEACTIVATED |

OUTPUT AMPLIFIER CIRCUIT AND DATA DRIVER OF DISPLAY DEVICE USING THE SAME

REFERENCE TO RELATED APPLICATION

This application is based upon and claims the benefit of the priority of Japanese patent application No. 2008-091751, filed on Mar. 31, 2008, the disclosure of which is incorporated herein in its entirety by reference thereto.

TECHNICAL FIELDS

The present invention relates to an output amplifier circuit and a data driver of a display device using the output amplifier circuit.

BACKGROUND

In recent years, a demand for liquid crystal display devices for use in large-screen liquid crystal TV sets as well as for use in portable telephones (such as mobile phones or cellular phones), notebook PCs, and monitors has expanded. As these liquid crystal display devices, the liquid crystal display devices with an active matrix driving system that enables high-resolution display are utilized. First, a typical configuration of the liquid crystal display device with the active matrix driving system will be outlined with reference to FIG. 14. In FIG. 14, a main configuration connected to one pixel in a liquid crystal display unit is schematically shown in the form of an equivalent circuit.

Referring to FIG. 14, a display unit 960 of the liquid crystal display device with the active matrix driving system generally comprises a semiconductor substrate, an opposed substrate, and a structure with liquid crystals sealed therein between these opposed two substrates. In the semiconductor substrate, transparent pixel electrodes 964 and thin-film transistors (TFTs) 963 (in the case of a color SXGA panel, for example, 1280×3 pixel rows×1024 pixel columns) are arranged in a matrix form. On the entire surface of the opposed substrate, one transparent electrode 967 is formed.

Turning on/off of a TFT 963 having a switching function is controlled by a scan signal. When the TFT 963 is turned on, a gray scale signal voltage corresponding to a video data signal is applied to a pixel electrode 964. The transmissivity of a liquid crystal changes due to a difference in potential between each of the pixel electrodes 964 and the opposed substrate electrode 967. Even after the TFT 963 has been turned off, the difference in potential is held at a liquid crystal capacitance 965 and an auxiliary capacitance 966 for a certain time interval, thereby displaying an image.

On the semiconductor substrate, data lines 962 that send a plurality of levels of voltage (gray scale voltages) applied to the respective pixel electrodes 964 and scan lines 961 that send scan signals are arranged in a matrix form (in the case of the color SXGA panel, 1280×3 data lines and 1024 scan lines are arranged). The scan lines 961 and the data lines 962 become large capacitive loads due to capacitances generated at mutual intersections and liquid crystal capacitances sandwiched with the opposed substrate electrode.

The scan signal is supplied to a scan line 961 by a gate driver 970, and supply of the gray scale signal voltage to each of the pixel electrodes 964 is performed from a data driver 980 through a data line 962. The gate driver 970 and the data driver 980 are controlled by a display controller 950. A clock CLK, a control signal, and the like are supplied to each of the gate driver 970 and the data driver 980 from the display controller 950. Supply voltages are supplied to each of the gate driver 970 and the data driver 980 from a voltage circuit 940. Video data is supplied to the data driver 980. Currently, digital data has become wide-spread use, as the video data.

Rewriting of data for one screen is performed in one frame time interval (usually, approximately 0.017 seconds at a time of 60 Hz driving), and each pixel row (each line) is selected one by one for each scan line. The gray scale voltage signal is supplied from each data line within the time interval of the selection. There cased in which a plurality of pixel rows may be simultaneously selected, or driving may be performed at a frame frequency of 60 Hz or higher.

While the gate driver 970 should supply at least a binary scan signal, the data driver 980 needs to drive the data line by the gray scale voltage signal of multi-valued levels corresponding to the number of gray scales. For this reason, the data driver 980 includes a digital-to-analog converter circuit (DAC) constituted from a decoder that converts the video data to an analog voltage and an operational amplifier that amplifies the analog voltage and outputs the amplified analog voltage to a corresponding data line 962.

As a method of driving large-screen display devices such as the monitor and the liquid crystal TV sets, a dot inversion driving scheme capable of realizing high picture quality is adopted. In the dot inversion driving scheme, an opposed substrate electrode voltage VCOM is set to a constant voltage and voltage polarities held in adjacent pixels are mutually opposite in the display panel 960 in FIG. 14. For this reason, the polarities of the voltages output to the adjacent data lines 962 become positive-polarity and negative-polarity with respect to the opposed substrate electrode voltage VCOM. In the dot inversion driving, polarity inversion of a data line is usually performed for each horizontal period. When a data line load capacitance is especially large, or when a frame frequency is high, a driving method in which the polarity inversion is performed for each N horizontal periods (in which N is an integer not less than two) is also employed.

FIG. 15A is a diagram showing a configuration of an output amplifier circuit (output circuit) in a data driver that drives a data line (refer to Patent Document 1 or the like). FIG. 15B is a timing diagram for explaining an operation in FIG. 15A.

The output amplifier circuit includes a differential stage 900 with a non-inverting input terminal thereof connected to an input terminal N1, a pMOS transistor M93 having a source thereof connected to a first power supply terminal (VDD), a gate thereof connected to a first output of the differential stage 900, and a drain thereof connected to an output terminal N3, and an nMOS transistor M94 having a source thereof connected to a second power supply terminal (VSS), a gate thereof connected to a second output of the differential stage 900, and a drain thereof connected to the output terminal N3. The output terminal N3 is connected to an inverting input terminal of the differential stage 900. An output switch SW90 is provided between the output terminal N3 of the output amplifier circuit and a load (data line) 90.

The output switch SW90 is controlled to be in an off state for a predetermined time interval (T1) from a start of each data period (t1H) in order to prevent degradation of display. The degradation of display is caused by transition noise at a time of change of an input signal (analog data) which is supplied to the input terminal N1. This noise is amplified at the output amplifier circuit, and is then transmitted to the load (data line) 90, thereby causing the degradation of display. In the time interval (T1) where a signal HSTB in FIG. 15B is High, transition of an analog data signal is completed. In a time interval (T2) where the signal HSTB is Low (T2), the output switch SW90 is turned on. The load (data line) 90 is thereby driven by a gray scale voltage that has been output from the output amplifier circuit, corresponding to the input signal.

When a large-sized high-resolution LCD panel is driven, the capacitance of the load 90 is increased, and one data period (t1H) is shortened. For this reason, due to an on resistance of the output switch SW90, a driving speed becomes insufficient. Further, since charging and discharging are performed through the output switch SW90, power dissipation and heat generation are also increased due to the on resistance of the output switch SW90.

In order to reduce the resistance of the output switch SW90 to cope with this problem, the size of the output switch SW90 needs to be increased. An increase in the area of the output amplifier circuit is thereby brought about.

A related art of an amplifier in which there is omitted an output switch will be described below. FIG. 16 is a diagram showing a configuration of a drive circuit disclosed in Patent Document 2, in which the output switch between the amplifier and a data line is eliminated. Referring to FIG. 16, this drive circuit 201 includes differential units 202 and 203, switching units 204 and 205, output units 206, 207, 208, and 209, and display output terminals 210 and 211 of the amplifier, and a control circuit 212 that controls these circuits. Gray scale voltages corresponding to display data are supplied to first inputs of the differential units 202 and 203, respectively. The switching unit 204 selectively connects an output of the differential unit 202 to one of the output units 206 and 208. The switching unit 205 selectively connects an output of the differential unit 203 to one of the output units 207 and 209. The switching unit 204 further connects one of the display output terminals 210 and 211 to a second input of the display unit 202. Likewise, the switching unit 205 connects one of the display output terminals 210 and 211 to a second input of the differential unit 203. The four output units 206, 207, 208, and 209 are provided for the display output terminals 210 and 211. Each of the output units 206 and 208 outputs a positive-polarity signal, while each of the output units 207 and 209 outputs a negative-polarity signal. Each of the output units 206 and 208 is configured to have high charging capability, and each of the output units 207 and 209 is configured to have high discharging capability. Signals such as a clock signal CLK, a latch signal STB, a polarity signal POL are supplied to the control circuit 212. The control circuit 212 generates a control signal necessary for controlling each unit. The control circuit 212 includes a bias voltage generation unit 213 that supplies a bias voltage to a constant current source in each of the differential unit and the output unit.

To the display output terminal 210, the output unit 206 that outputs the positive-polarity signal and the output unit 209 that outputs the negative-polarity signal are connected. The control circuit 212 controls the output units 206 and 209 so that only one of the output units 206 and 209 is activated. To the display output terminal 211, the output unit 207 that outputs the negative-polarity signal and the output unit 208 that outputs the positive-polarity signal are connected. The control circuit 212 controls the output units 207 and 208 so that only one of the output units 207 and 208 is activated. The signals of the polarities that are different to each other are generated for the display output terminals 210 and 211, in order to implement dot inversion driving. In a certain horizontal period, the output unit 206 outputs the positive-polarity signal to the display output terminal 210, and the output unit 207 outputs the negative-polarity signal to the display output terminal 211. In this case, the output units 208 and 209 are deactivated. On the other hand, in the next horizontal period, the output unit 208 outputs the positive-polarity signal to the display output terminal 211, and the output unit 209 outputs the negative-polarity signal to the display output terminal 210. In this case, the output units 206 and 207 are deactivated. There is no need for providing the output switch between each of the output terminals 210 and 211 and each of the output units 206, 207, 208, and 209.

FIGS. 17A and 17B are diagrams respectively showing a detailed configuration and operation of the drive circuit in FIG. 16 (refer to Patent Document 2). The differential unit 202 in FIG. 16 is composed of transistors 21 to 24 and a current source 25, and the differential unit 203 in FIG. 16 is composed of transistors 31 to 34 and a current source 35. Each of the differential units 202 and 203 in FIG. 16 is composed of medium-voltage elements. The switching unit 204 in FIG. 16 is composed of switches 41 to 46, and the switching unit 205 in FIG. 16 is composed of switches 51 to 56. The switches 45, 46, 55, and 56 that constitute the switching units 204 and 205 in FIG. 16 are composed of high-voltage elements, and the other switches except these switches are composed of medium-voltage elements. The output unit 206 in FIG. 16 is composed of transistors 61 and 62, while the output unit 207 is composed of transistors 71 and 72. The output unit 208 is composed of transistors 81 and 82, while the output unit 209 is composed of transistors 91 and 92. Each of the output units 206, 207, 208, and 209 is composed of high-voltage elements.

Patent Document 3 discloses a configuration as shown in FIG. 18, as an offset cancelling amplifier, though an object and control of the offset cancelling amplifier in Patent Document 3 are different from those of the present invention. Referring to FIG. 18, a differential circuit 10 includes nMOS transistors M3 and M4 having sources thereof connected in common to form a differential pair, an nMOS transistor M9 (current source) connected to the common source of the nMOS transistors M3 and M4, and a current mirror circuit formed of pMOS transistors M1 and M2 with drains thereof respectively connected to drains of the nMOS transistors M3 and M4. The offset cancelling amplifier includes a pMOS transistor M7 having a source thereof connected to a power supply terminal VDD and a gate thereof connected to a drain of the nMOS transistor M4. A drain N1 of the pMOS transistor M7 is fed back to a gate of the transistor M3 through a switch SW2. The offset cancelling amplifier includes an nMOS transistor M10 (current source transistor for pulling down) having a source thereof connected to the ground, a drain thereof connected to the drain N1 of the pMOS transistor M7. A gate of the nMOS transistor M10 receives a bias voltage VBB. The offset cancelling amplifier includes a pMOS transistor M11 having a source thereof connected to the power supply terminal VDD and a drain thereof connected to an output terminal OUT, an nMOS transistor M12 having a source thereof connected to a power supply terminal VSS and a drain thereof connected to the output terminal OUT, a pMOS transistor M13 that is connected between the gate of the transistor M7 and a gate of the transistor M11 and has a gate thereof connected to a control signal CON, a nMOS transistor M15 that is connected between a gate of the transistor M12 and the gate of the transistor M10 and has a gate thereof connected to an inverted signal of the control signal CON (output of an inverter INV2), a pMOS transistor M14 having a source thereof connected to the power supply terminal VDD and a drain thereof connected to the gate of the transistor M11, and an nMOS transistor M16 having a source thereof connected to the power supply terminal VSS and a drain thereof connected to the gate of the transistor M12. A gate of the pMOS transistor M14 receives a signal obtained by inverting the control signal CON by an inverter INV1. The nMOS transistor 16 receives a signal obtained by inverting the control signal CON by the inverter INV2 and then further inverting the resulting signal by an inverter INV3.

An offset cancel circuit 11 that stores an offset state is connected to the input stage differential pair of the transistors M3 and M4. The offset cancel circuit 11 stores a voltage (IN+Vof) obtained by adding an offset voltage Vof to an input voltage IN.

The offset cancel circuit 11 includes offset cancelling (nMOS) transistors M5 and M6 arranged in parallel with the differential pair transistors M3 and M4, an (nMOS) current source transistor M8 connected to a commonly-connected source of the transistors M5 and M6, and an offset cancel capacitance C1 connected to a gate of the transistor M5. A predetermined bias voltage VBB is applied to respective gates of the current source transistors M8 and M9 and the gate of the current source transistor M10.

In an offset cancel time interval, a switch SW2 is turned off, and switches SW1 and SW3 are turned on, thereby applying an input voltage IN to gates of the transistors M3, M4, and M6. In this case, the drain N1 of the transistor M7 is fed back to a gate N2 of the transistor M5 in the offset cancel circuit 11 through the switch SW3, thereby forming a voltage follower configuration for the input voltage IN. As a result, the voltage (IN+Vof) obtained by adding the offset voltage Vof to the input voltage IN is stored in the capacitance C1.

In the subsequent operational amplifier operation time interval, the switch SW2 is turned on, and the switches SW1 and SW3 are turned off, thereby causing the drain N1 of the output transistor M7 to be fed back to a gate of the transistor M3. The voltage at the gate of each of the transistors M5 and M6 of the offset cancel circuit 11 is maintained. As a result, the gate of the transistor M3 is stablized at the input voltage IN, and the input voltage IN is generated at the drain N1 of the transistor M7.

Further, the (pMOS) transistor M11 and the (nMOS) transistor M12 (in a second output stage) are connected in parallel with the transistors M7 and M10 (in a first output stage), and the switching transistor M13 and M14 (both of which are pMOS transistors) are provided for a gate of the transistor M11. Further, the switching transistors M15 and M16 (both of which are nMOS transistors) are connected to the gate of the transistor M12, which is a second output current source transistor. These switching transistors M12, M14, M15, and M16 are respectively controlled to be turned on or off responsive to the control signal CON, the inverted control signal of the control signal CON that is inverted by the inverter INV1, the inverted control signal of the control signal CON that is inverted by the inverter INV2, and the inverted control signal obtained by inverting the control signal CON by the inverters INV2 and INV3.

In this operational amplifier circuit, when the offset cancel time interval is completed, the transistors M11 and M12 are disconnected from the transistors M7 and M10, and the gates of the transistors M11 and M12 are respectively connected to a power supply VDD and the ground GND, thereby causing the transistors M11 and M12 not to be operated. That is, by switching the control signal CON from a Low level to a High level, the transistors M13 and M15 are both turned off, and the transistors M14 and M16 are both turned on. Then, a switch SW4 is turned on, so that the operational amplifier circuit enters into the operation time interval. As a result, in the subsequent operational amplifier operation time interval, a control operation on the transistor M11 using an output of the differential circuit 10 is stopped, so that the transistor M11 is deactivated. Likewise, the output current source transistor M12 is also deactivated.

FIG. 18B is a table showing operations of the output unit of the circuit in FIG. 18A. In the offset cancel time interval, the switch SW4 is turned off, the transistors M13 and M15 are turned on, and the transistors M14 and M16 are turned off. Then, the second output stage (M11, M12) is activated. In the operational amplifier operation time interval, the switch SW4 is turned on, the transistors M13 and M15 are turned off, and the transistors M14 and M16 are turned on. Then, the second output stage (M11, M12) is deactivated.

[Patent Document 1]
JP Patent Kokai Publication No. JP-P-2007-47342A
[Patent Document 2]
JP Patent Kokai Publication No. JP-P-2007-156235A
[Patent Document 3]
JP Patent Kokai Publication No. JP-P-2003-60453A
[Patent Document 4]
JP Patent Kokai Publication No. JP-A-6-326529
[Patent Document 5]
JP Patent Kokai Publication No. JP-P-2005-124120A

SUMMARY

The disclosure of the above Patent Documents are incorporated herein by reference thereto. An analysis of the related arts by the present invention will be given below.

Due to an increase in a data line load capacitance and higher resolution caused by an increase in the size of liquid crystal TV sets, a data driving time interval also tends to be reduced.

In a driver that drives a large capacitance load, a driving speed tends to become insufficient due to an on resistance of an output switch provided between an output amplifier circuit and a data line load, and power dissipation and heat generation at the output switch will also increase. When the driving speed is to be improved, the size of the output switch will increase, thereby affecting the chip area.

The configurations shown in FIGS. 16 and 17 are those without the output switches, in which there is no need for providing a selector switch between each display output terminal and the output unit. The switches 41, 43, 51, 53, 45, 46, 55, and 56 are set to be turned off for a predetermined time interval from a start of one data period (time interval in which the STB signal in FIG. 17B is High). The differential stage is thereby disconnected from the output stage.

That is, internal elements (such as a phase compensation capacitor) cannot transition to a state corresponding to subsequent data supplied at the start of the one data period, for the predetermined time interval from the start of the one data period.

For this reason, when the differential pair and the output stage are connected in a driving time interval after completion of the predetermined time interval (when the switches 41, 43, 51, 53, 45, 46, 55, and 56 are switched to be turned on), noise may be generated in an output, or an output delay may occur.

Accordingly, it is an object of the present invention to provide an output amplifier circuit, an output circuit, a data driver, and a display device to realize high speed driving of a data line loading and reduction of power dissipation and heat generation caused by an on resistance of the output switch.

Another object of the present invention is to provide an output amplifier circuit, an output circuit, a data driver, and a display device which can also provide area reduction and restrain generation of output noise, in addition to achieving the object described above.

The invention, which seeks to solve one or more of the problems described above, are summarized as follows.

According to one aspect of the present invention, there is provided an output amplifier circuit including: a main amplifier and a sub-amplifier that share a differential circuit which receives an input signal. A load to be driven is connected to an output of the main amplifier. The input signal is received by the sub-amplifier of a voltage follower configuration, with the output of the main amplifier turned off and an output of the sub-amplifier disconnected from the load. The input signal is then received by both of the main amplifier and the sub-amplifier of the voltage follower configuration, or by the main amplifier of the voltage follower configuration alone to drive the load, with the output of the main amplifier turned on.

In the present invention, there is provided an output amplifier circuit including:

a differential stage receiving an input signal at an non-inverting input thereof;

a first output stage having first and second inputs connected to first and second outputs of the differential stage, respectively;

a second output stage having an output thereof connected to a load to be driven; and a connection control circuit performing switching between:

a first connection configuration in which the first and second outputs of the differential stage are electrically disconnected from first and second inputs of the second output stage, an output of the first output stage is electrically disconnected from an output of the second output stage, and the output of the first output stage is electrically connected to an inverting input of the different stage; and a second connection configuration in which the first and second outputs of the differential stage are electrically connected to the first and second inputs of the second output stage, respectively, and at least the output of the second output stage out of the first and second output stages is electrically connected to the inverting input of the differential stage.

In the first connection configuration, the connection control circuit of the present invention deactivates the second output stage; and in the second connection configuration, the connection control circuit activates the second output stage.

In the present invention, a data period where the input signal is received and then the load is driven includes:

a first time interval from a starting point of time of the data period; and a second time interval after the first time interval;

the first connection configuration is employed in the first time interval; and the second connection configuration is employed in the second time interval.

In the present invention, in the first connection configuration, the inverting input of the differential stage is connected to the output of the first output stage; and in the second connection configuration, the output of the first output stage is electrically connected to the output of the second output stage, and the output of the first output stage and the output of the second output stage are connected in common to the inverting input of the differential stage. In the present invention, the connection control circuit includes:

a first switch provided between a first output of the differential stage and a first input of the second output stage and a second switch provided between a second output of the differential stage and a second input of the second output stage; and a third switch provided between the output of the first output stage and the output of the second output stage. In the first connection configuration, all of the first through third switches are turned off; and in the second connection configuration, all of the first through third switches are turned on.

Alternatively, in the present invention, in the first connection configuration, the inverting input of the differential stage is electrically connected to the output of the first output stage, and the inverting input of the differential stage is electrically disconnected from the output of the second output stage; and in the second connection configuration, the inverting input of the differential stage is electrically connected to the output of the second output stage, and the inverting input of the differential stage is electrically disconnected from the output of the first output stage. The connection control circuit includes:

a first switch provided between a first output of the differential stage and a first input of the second output stage and a second switch provided between a second output of the differential stage and a second input of the second output stage;

a third switch provided between the output of the first output stage and the inverting input of the differential stage; and a fourth switch provided between the output of the second output stage and the inverting input of the differential stage. In the first connection configuration, all of the first, second, and fourth switches are turned off, and the third switch is turned on; and in the second connection configuration, all of the first, second, and fourth switches are turned on, and the third switch is turned off.

In the present invention, the first output stage includes:

first and second transistors arranged in series between a first power supply terminal that supplies a first power supply potential and a second power supply terminal that supplies a second power supply potential, control terminals of the first and second transistors respectively being connected to first and second outputs of the differential stage.

The second output stage includes:

third and fourth transistors arranged in series between the first power supply terminal and the second power supply terminal. A connection node between the first and second transistors constitutes an output node of the first output stage. A connection node between the third and fourth transistors constitutes an output node of the second output stage. The connection control circuit includes:

a first switch provided between a control terminal of the first transistor and a control terminal of the third transistor;

a second switch provided between a control terminal of the second transistor and a control terminal of the fourth transistor;

a third switch provided between the output node of the first output stage and the output node of the second output stage;

a fourth switch provided between the control terminal of the third transistor and one of the first and second power supply terminals that applies a voltage to the control terminal of the third transistor, thereby turning off the third transistor; and a fifth switch provided between the control terminal of the fourth transistor and one of the first and second power supply terminals that applies a voltage to the control terminal of the fourth transistor, thereby turning off the fourth transistor. In the first connection configuration in the present invention, all of the first through third switches are turned off, and both of the fourth and fifth switches are turned on; and in the second connection configuration, all of the first through third switches are turned on, and both of the fourth and fifth switches are turned off.

In the present invention, the first output stage includes:

first and second transistors arranged in series between a first power supply terminal that supplies a first power supply potential and a second power supply terminal that supplies a second power supply potential, control terminals of the first and second transistors respectively constituting first and second inputs of the first output stage and being respectively connected to first and second outputs of the differential stage. The second output stage includes:

third and fourth transistors arranged in series between the first power supply terminal and the second power supply terminal, control terminals of the third and fourth transistors respectively constituting first and second inputs of the second output stage. A connection node between the first and second transistors constitutes an output node of the first output stage. A connection node between the third and fourth transistors constitutes an output node of the second output stage. The connection control circuit may include:

a first switch provided between a control terminal of the first transistor and a control terminal of the third transistor;

a second switch provided between a control terminal of the second transistor and a control terminal of the fourth transistor;

a third switch provided between the output node of the first output stage and the output node of the second output stage;

a fourth switch provided between the control terminal of the third transistor and one of the first and second power supply terminals that applies a voltage to the control terminal of the third transistor, thereby turning off the third transistor; and a fifth switch provided between the control terminal of the fourth transistor and a first terminal of the fourth transistor connected to the output node of the second output stage.

In the present invention, the connection control circuit may deactivate the first output stage in the second connection configuration.

In the present invention, the control connection circuit includes:

a sixth switch provided between the control terminal of the first transistor and a first output of the differential stage;

a seventh switch provided between the control terminal of the first transistor and one of the first and second power supply terminals that applies a voltage to the control terminal of the first transistor, thereby turning off the first transistor;

an eighth switch provided between the control terminal of the second transistor and a second output of the differential stage; and a ninth switch provided between the control terminal of the second transistor and one of the first and second power supply terminals that applies a voltage to the control terminal of the second transistor, thereby turning off the second transistor. In the present invention, in the first connection configuration, the sixth and eighth switches are turned on and the seventh and ninth switches are turned off, and in the second connection configuration, the sixth and eighth switches are turned off and the seventh and ninth switches are turned on.

In the present invention, the differential stage may include:

a first differential pair of a first conductivity type and a first current source that supplies a driving current to the first differential pair;

a second differential pair of a second conductivity type and a second current source that supplies a driving current to the second differential pair, non-inverting inputs of the first and the second differential pairs being coupled together, inverting inputs of the first and second differential pairs being coupled together;

a first cascode current mirror circuit connected to a differential output pair of the first differential pair;

first and second floating current sources having one ends thereof connected to first and second terminals of the first cascode current mirror circuit, respectively; and a second cascode current mirror circuit connected to a differential output pair of the second differential pair, first and second terminals of the second cascode current mirror circuit being connected to the other ends of the first and second floating current sources, respectively; and the first terminals of the first and second cascode current mirror circuits are set to the first and second outputs of the differential stage.

Alternatively, the differential stage in the present invention may include:

a first differential pair of a first conductivity type and a second differential pair of a second conductivity type, the first differential pair being driven by a first current source, the second differential pair being driven by a second current source, output pairs of the first differential pair and the second differential pair being respectively connected to first and second load circuits, the first input of the first differential pair and the first input of the second differential pairs being connected, the second inputs of the first and second differential pairs being connected;

a transistor of the second conductivity type connected between the first power supply terminal and an output of the first differential pair and biased by a predetermined voltage;

a floating current source connected between the output of the first differential pair and an output of the second differential pair; and a transistor of the first conductivity type connected between the second power supply terminal and the output of the second differential pair and biased by a predetermined voltage; and the output of the first differential pair and the output of the second differential pair are respectively set to the first and second outputs of the differential stage.

Alternatively, the differential stage in the present invention may include:

a differential pair driven by a current source and having an output pair thereof connected to a load circuit;

a transistor connected between the first power supply terminal and an output of the differential pair and biased by a predetermined voltage;

a floating current source with one end thereof connected to the output of the differential pair; and other transistor connected between the other end of the floating current source and the second power supply terminal;

the one and other ends of the floating current source being set to the first and second outputs of the differential stage.

An output circuit of the present invention includes:

a first input terminal that receives a positive-polarity signal;

a second input terminal that receives a negative-polarity signal;

first and second output terminals;

an input switching circuit that performs switching between output of the positive-polarity signal from the first output terminal and the negative-polarity signal from the second output terminal and output of the negative-polarity signal from the first output terminal and the positive-polarity signal from the second output terminal; and a first output amplifier circuit connected to a first output terminal of the input switching circuit to drive a first load and a second output amplifier circuit connected to a second output terminal of the input switching circuit to drive a second load;

each of the first and second output amplifier circuits including the output amplifier circuit according to the present invention described above.

In the output circuit according to the present invention, a load driving time interval in which the output circuit receives the positive-polarity signal and the negative-polarity signal and then drives the first and second loads comprises a plurality of the data periods;

each of the data periods includes:

a first time interval from a starting point of time of the data period; and a second time interval after the first time interval;

in the first time interval, each of the first and second output amplifier circuits is set to the first connection configuration, and the second output stage is deactivated; and in the second time interval, each of the first and second output amplifier circuits is set to the second connection configuration, and the second output stage is activated.

Alternatively, in the output circuit of the present invention, a driving time interval in which the output circuit receives the positive-polarity signal and the negative-polarity signal and then drives the first and second loads includes:

a plurality of the data periods in which the first and second loads are respectively driven by positive polarity and negative polarity; and a plurality of the data periods in which the first and second loads are respectively driven by the negative polarity and the positive polarity;

at least a first data period after switching of the polarities of the first and second loads has been performed includes:

a first time interval from a starting point of time of the data period; and a second time interval after the first time interval;

in the first time interval, each of the first and second output amplifier circuits is set to the first connection configuration, and the second output stage is deactivated; and in the second time interval, each of the first and second output amplifier circuits is set to the second connection configuration, and the second output stage is activated.

Further, in the circuit of the present invention, in one of the data period in which the polarities of the first and second loads are the same as those in an immediately preceding one of the data periods, each of the first and second output amplifier circuits may be set to the second connection configuration, and the second output stage is activated.

Alternatively, an output circuit of the present invention includes:

a first output amplifier circuit that receives a positive-polarity signal and then drives a first load or a second load; and a second output amplifier circuit that receives a negative-polarity signal and then drives the second load by negative polarity when the first output amplifier circuit drives the first load by positive polarity and drives the first load by the negative polarity when the first output amplifier circuit drives the second load by the positive polarity. Each of the first and second output amplifier circuits includes the output amplifier circuit of the present invention described above. Then, the output circuit includes:

a switching circuit that switches:

connection between respective outputs of the differential stages of the first and second output amplifier circuits and respective inputs of the second output stages of the first and second output amplifier circuits to either straight connection or cross connection; and connection between respective outputs of the second output stages of the first and second output amplifier circuits and respective outputs of the first output stages of the first and second output amplifier circuits to either straight connection or cross connection.

An output circuit of the present invention may include:

a first output amplifier circuit that receives a positive-polarity signal and then drives a first load or a second load;

a second output amplifier circuit that receives a negative-polarity signal and then drives the second load by negative polarity when the first output amplifier circuit drives the first load by positive polarity and drives the first load by the negative polarity when the first output amplifier circuit drives the second load by the positive polarity, each of the first and second output amplifier circuits being constituted from the output amplifier circuit of the present invention described above;

a first switching circuit that switches:

connection between the respective first outputs of the differential stages of the first and second output amplifier circuits and the respective control terminals of the third transistors in the second output stages of the first and second output amplifier circuits to either straight connection or cross connection;

a second switching circuit that switches:

connection between the respective outputs of the second output stages of the first and second output amplifier circuits and the respective outputs of the first output stages of the first and second output amplifier circuits to either straight connection or cross connection; and a third switching circuit that switches:

connection between the respective second outputs of the differential stages of the first and second output amplifier circuits and the respective control terminals of the fourth transistors in the second output stages of the first and second output amplifier circuits to either straight connection or cross connection.

According to the present invention, there is provided a data driver that drives a data line of a display device as a load, the display device comprising unit pixels each including a pixel switch and a display element, at an intersection between the data line and a scan line, including:

the output amplifier circuits of the present invention described above.

Alternatively, according to the present invention, there is provided a data driver that drives first and second data lines of a display device as first and second loads, the display device including unit pixels each having a pixel switch and a display element, at an intersection between a data line and a scan line, wherein as an output circuit including first and second output amplifier circuits that receive a positive-polarity signal from a positive-polarity decoder and a negative-polarity signal from a negative-polarity decoder and then drives the first and second loads, the output circuit of the present invention described above is included. The data driver according to the present invention includes at least one control signal generation circuit that supplies a control signal which controls switching of the connection configurations to a plurality of the output circuits.

According to the present invention, by eliminating an output switch, an increase in a speed of driving a load can be performed. Then, reduction of power dissipation and heat generation caused by an on resistance of the output switch can be performed. In addition to the above effects, the present invention can perform area reduction and restrain output noise generation, by elimination of an output switch.

Still other features and advantages of the present invention will become readily apparent to those skilled in this art from the following detailed description in conjunction with the accompanying drawings wherein only exemplary embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED MODES

Figure 1A:
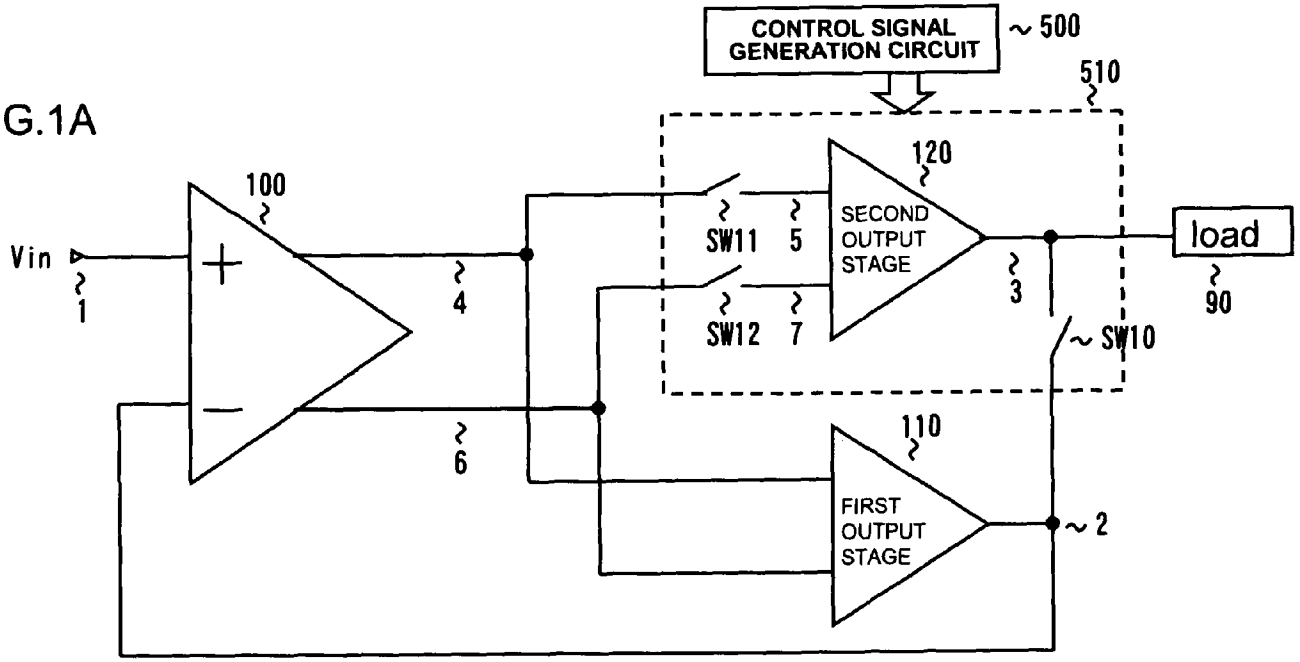
FIGS. 1A and 1B are diagrams respectively showing a configuration and control in a first exemplary embodiment of the present invention.

A description of preferred modes will be given below, with reference to drawings. Referring to FIG. 1, an output amplifier circuit in accordance with one aspect of the present invention includes: a differential stage (100), a first output stage (110) that receives outputs (4, 6) of the differential stage (100), and a second output stage (120) having an output (3) thereof connected to a load (90) to be driven. The differential stage (100) receives an input signal (Vin) at a first input (non-inverting input) of an input pair thereof. The output amplifier circuit further includes a control circuit (510) that is controlled by a control signal generated by a control signal generation circuit (500).

The control circuit (510) switches:

(A) a first connection configuration in which the outputs (4, 6) of the differential stage (100) are electrically disconnected from inputs (5, 7) of the second output stage (120), an output (2) of the first output stage (110) is electrically disconnected from the output (3) of the second output stage (120), and the output (2) of the first output stage (110) is electrically connected to a second input (inverting input) of the input pair of the differential stage (100); and (B) a second connection configuration in which the outputs (4, 6) of the differential stage (100) are electrically connected to the inputs (5, 7) of the second output stage (120), and the outputs (2, 3) of the first output stage (110) and the second output stage (120) are electrically connected to the second input (inverting input) of the input pair of the differential stage (100).

The control circuit (510) performs control such that the second output stage (120) is deactivated in the first connection configuration, and the second output stage (120) is activated in the second connection configuration. This aspect of the present invention includes first and second switches (SW11, SW12) that are respectively connected between the first output (4) of the differential stage (100) and the first input (5) of the second output stage (120) and between the second output (6) of the differential stage (100) and the second input (7) of the second output stage (120), and a third switch (SW10) connected between the output (2) of the first output stage (110) and the output (3) of the second output stage (120). The output (2) of the first output stage (110) is connected to the second input (inverting input) of the input pair of the differential stage (100).

That is, in the output amplifier circuit that drives the load (90), an output stage that receives the outputs of the differential stage (100) includes the first output stage (110) including a first charging element and a first discharging element, the second output stage (120) including a second charging element and a second discharging element, and control means (500, 510) that control connection and operation of the second output stage (120). The control signal generation circuit (500) that supplies the control signal to the control circuit (510) may be provided separately from the output amplifier circuit.

The output (3) of the second output stage (120) is directly connected to the load (90).

A data period is constituted from at least first and second time intervals (T1, T2). In the first time interval (T1) (in which a signal HSTB is High), the switches (SW10, SW11, SW12) are turned off, the second output stage (120) is electrically disconnected from the outputs of the differential stage (100), and the second output stage (120) is deactivated (with the output thereof turned off). In this case, the differential stage (100) and the first output stage (110) perconstitute a voltage follower operation in accordance with the input signal (Vin).

In the second time interval (T2) (in which the signal HSTB is Low), the switches (SW10, SW11, SW12) are turned on, and the output node (3) of the second output stage (120) is feedback connected to the differential stage (100). Then, the second output stage (120) is activated. In this case, the differential stage (100) and at least the second output stage (120) drive the load (90) by the voltage follower operation in accordance with the input signal (Vin).

Figure 15A:
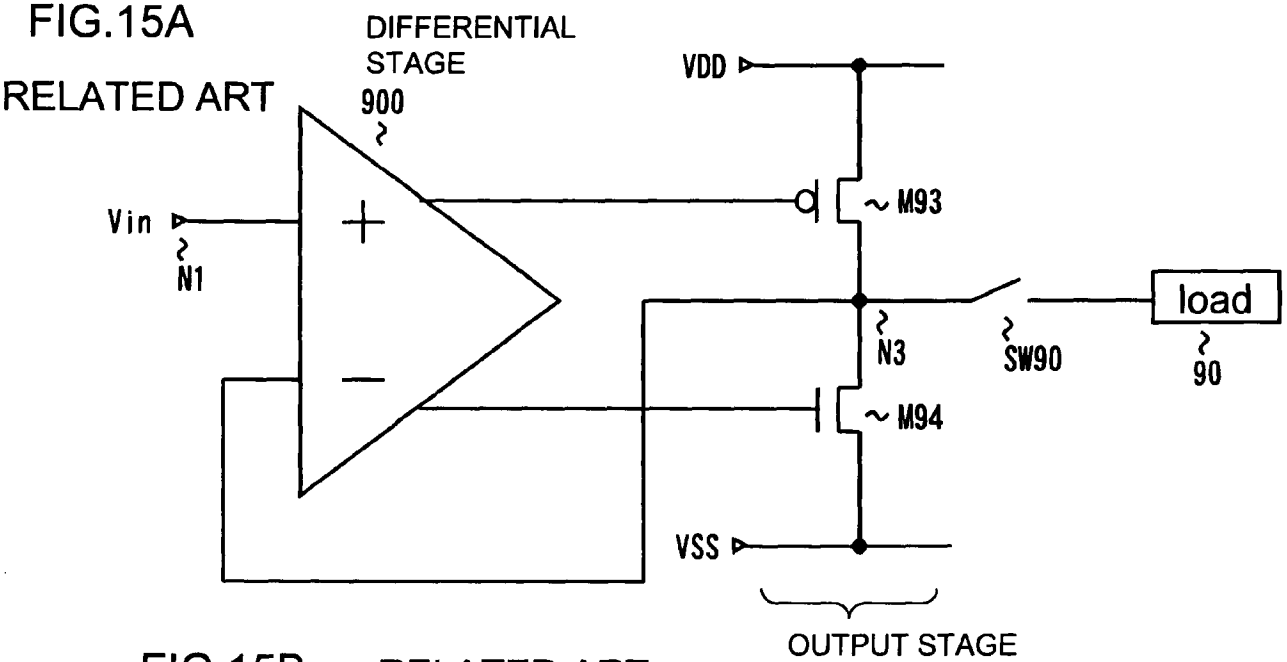
FIG.15A RELATED ART
FIG. 15 includes diagrams showing a configuration (with an output switch) of a prior art (related art)
Figure 15B:
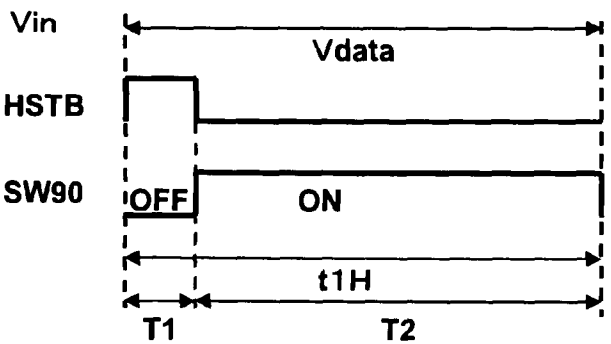
FIG.15B RELATED ART
Figure 16:
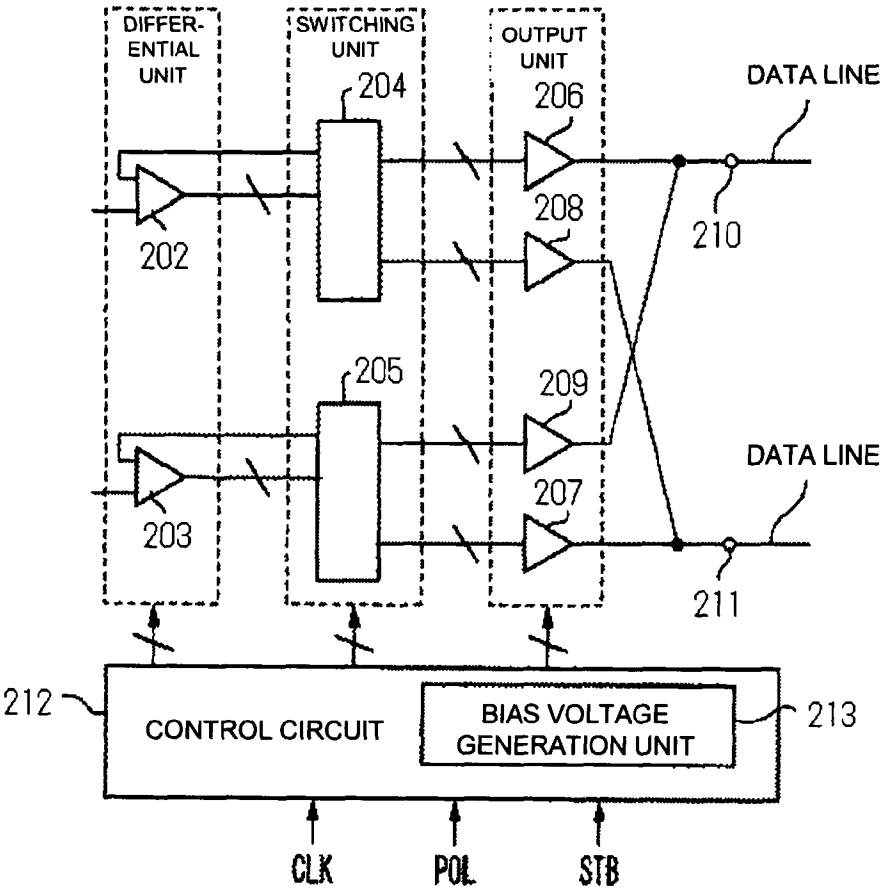
FIG.16 PRIOR ART
FIG. 16 is a diagram showing a configuration (without output switch) of a prior art (related art)
Figure 17B:
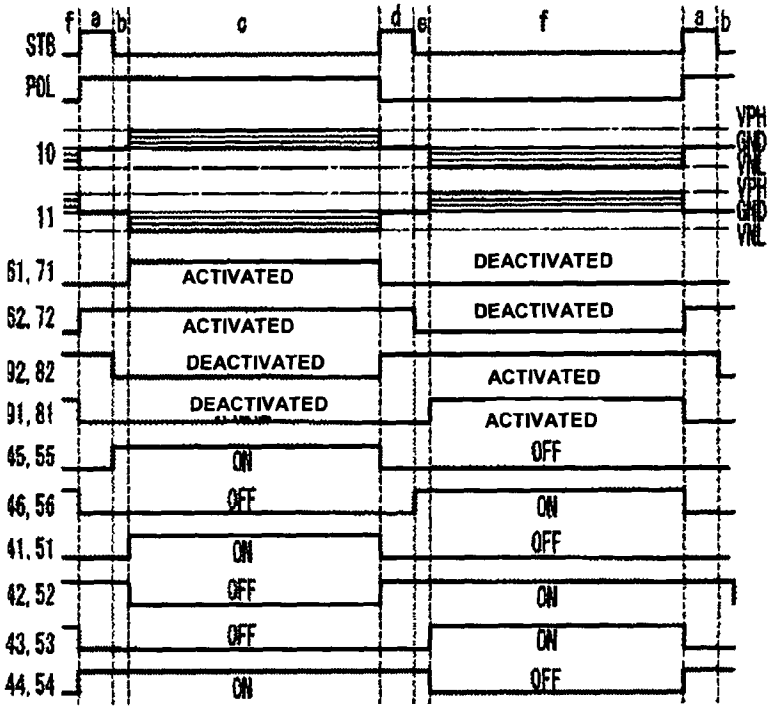
FIG.17B PRIOR ART
FIGS. 17A and 17B are diagrams respectively showing a detailed configuration and operation waveforms of FIG. 16.
Figure 17A:
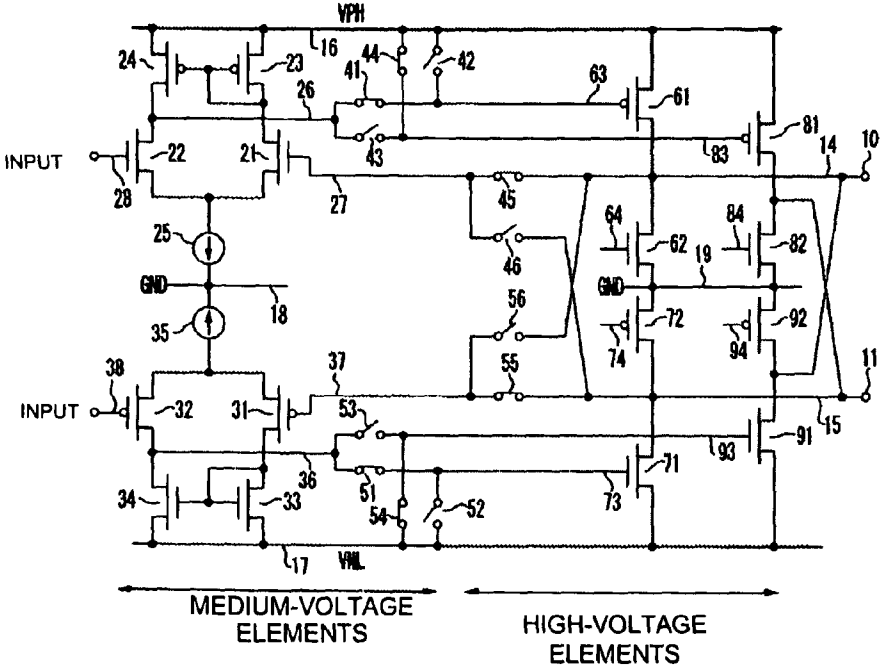
FIG.17A PRIOR ART
Figures 18A, 18B:
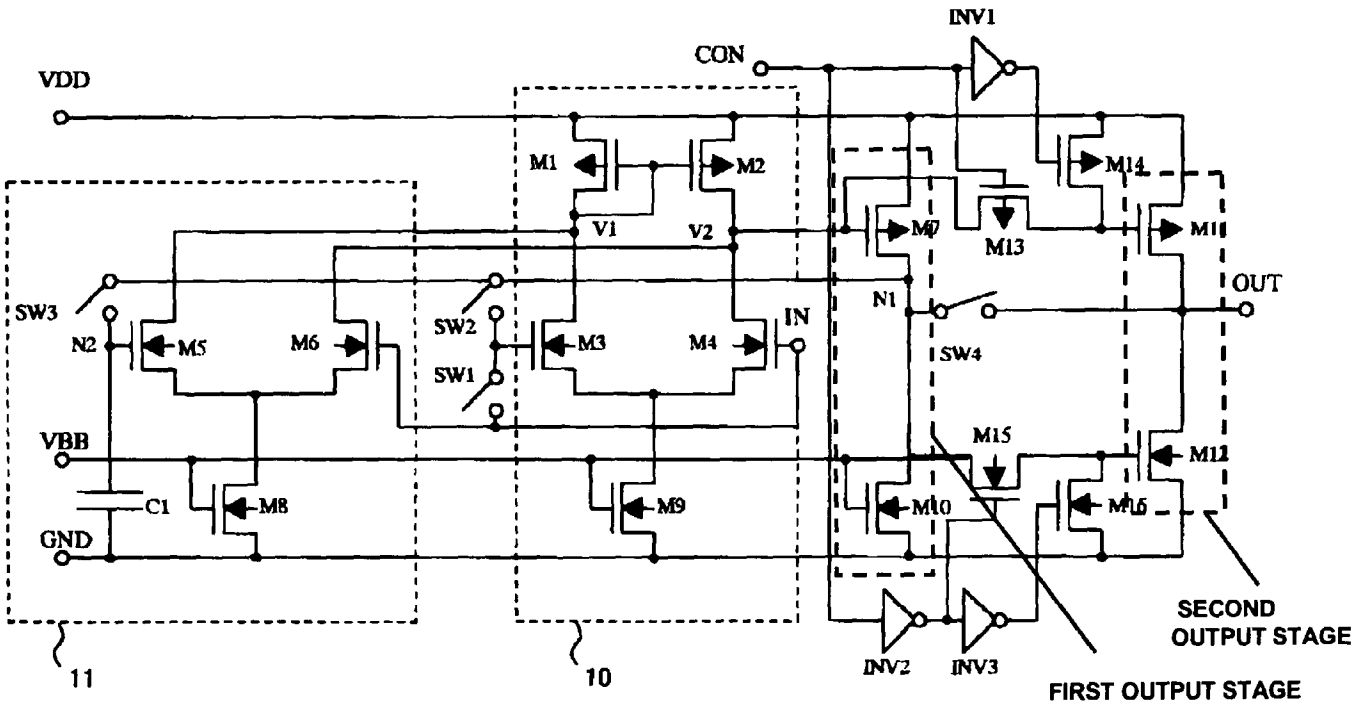
FIG.18A PRIOR ART
FIG. 18B PRIOR ART
FIGS. 18A and 18B are diagrams showing a configuration of an offset cancelling amplifier of a prior art (related art)

In the first time interval (T1), the output node (2) of the first output stage (110) is electrically disconnected from the output node (3) of the second output stage (120), and the second output stage (120) is deactivated. Then, voltage supply to the load (90) is cut off. The second output stage (120) performs an operation comparable to that of an output switch (an output switch SW90 in FIG. 15) in an off state.

Further, since the differential stage (100) and the first output stage (110) operate, corresponding to the input voltage (Vin) in the first time interval (T1), internal elements such as a phase compensation capacitor change to a state corresponding to the input voltage (Vin).

The internal elements such as the phase compensation capacitance are brought into the state corresponding to the input voltage (Vin) in the first time interval (T1). Thus, in the second time interval (T2) after completion of the first time interval (T1), noise generation at a time of switching from the first time interval (T1) to the second time interval (T2) is restrained, and the load (90) is driven at high speed by the activated second output stage (120).

The size of each of the first and second output stages (110, 120) and each of the switches (SW10, SW11, SW12) may be adjusted according to a condition of driving the load (90). Preferably, the sizes of the first output stage (110) and each of the switches (SW10, SW11, SW12) are set to be sufficiently small, and the size of each element of the second output stage (120) is set to the one necessary for driving the load (90). With this arrangement, a configuration in which the second output stage (120) directly coupled to the load (90) is set to a main amplifier and the first output stage (110) that drives the internal elements such as the phase compensation capacitance is set to a sub-amplifier can be implemented. According to the present invention, by eliminating the output switch, a high through rate, power saving, low heat generation (reduction of power dissipation and heat generation caused by an on-resistance of the output switch) are achieved for a large capacitance load as well. Further, according to the present invention, in an output circuit in which an output switch of a large size is disposed, area saving can also be implemented by eliminating the output switch.

Alternatively, referring to FIG. 19, an output amplifier circuit in another aspect of the present invention includes a differential stage (100), a first output stage (110) that receives outputs (4, 6) of the differential stage (100), and a second output stage (120) having an output (3) thereof connected to a load (90) to be driven. The differential stage (100) receives an input signal (Vin) at a first input (non-inverting input) of an input pair thereof. The output amplifier circuit further includes a control circuit (510) that is controlled by a control signal generated by a control signal generation circuit (500).

The control circuit (510) switches:

(A) a first connection configuration in which the outputs (4, 6) of the differential stage (100) are electrically disconnected from inputs (5, 7) to the second output stage (120), an output (2) of the first output stage (110) is electrically disconnected from the output (3) of the second output stage (120), and the output (2) of the first output stage is electrically connected to a second input (inverting input) of the input pair of the differential stage (100); and (B) a second connection configuration in which the outputs (4, 6) of the differential stage (100) are electrically connected to the inputs (5, 7) to the second output stage (120), and the output (2) of the first output stage (110) is electrically disconnected from the second input (inverting input) of the input pair of the differential stage (100), and the output (3) of the second output stage (120) is electrically connected to the second input (inverting input) of the input pair of the differential stage (100). The control circuit (510) performs control so that the second output stage (120) is deactivated in the first connection configuration, and the second output stage (120) is activated in the second connection configuration. This aspect of the present invention includes first and second switches (SW11, SW12) that are respectively connected between the first output (4) of the differential stage (100) and the first input (5) to the second output stage (120) and between the second output (6) of the differential stage (100) and the second input (7) to the second output stage (120), a third switch (SW10-1) connected between the output (2) of the first output stage (110) and the second input (inverting input) of the input pair of the differential stage (120), and a fourth switch (SW10-2) connected between the output (3) of the second output stage (120) and the second input (inverting input) of the input pair of the differential stage (100).

In the output amplifier circuit in each aspect described above, the differential stage (100) is shared by the first output stage (110) and the second output stage (120). The second output stage (120) and the first output stage (110) may be regarded as a main amplifier (differential stage (100) and the second output stage (120)) and a sub-amplifier (differential stage (100) and the first output stage (110)) that share a differential circuit (differential stage (100) that receives the input signal (Vin). In this output amplifier circuit, in a state where the load (90) to be driven is connected to the output (3) of the main amplifier (100, 120), the output of the main amplifier (100, 120) is turned off, and the output (2) of the sub-amplifier (100, 110) is disconnected from the load (90), the input signal (Vin) is received by the sub-amplifier (100, 110) of a voltage follower configuration. Then, in a state where the output of the main amplifier (100, 120) is turned on, the input signal (Vin) is received by both of the main amplifier (100, 120) and the sub-amplifier (100, 110) of the voltage follower configuration, or by only the main amplifier (100, 120) of the voltage amplifier configuration, and then the load (90) is driven. A description will be given below in connection with exemplary embodiments.

First Exemplary Embodiment

FIG. 1 is a diagram showing a configuration of an output amplifier circuit in an exemplary embodiment of the present invention. Referring to FIG. 1, this exemplary embodiment includes:

a differential stage 100;

a first output stage 110;

a second output stage 120;

a switch SW11 connected between a first output 4 of the differential stage 100 and a first input terminal 5 of the second output stage 120;

a switch SW12 connected between a second output 6 of the differential stage 100 and a second input terminal 7 of the second output stage 120;

a switch SW10 connected between an output node 2 of the first output stage 110 and an output node 3 of the second output stage 120; and a control signal generation circuit 500. The differential stage 100 includes at least a differential pair and a load circuit. Further, in an output amplifier circuit including an intermediate stage, the differential stage 100 includes the intermediate stage as well.

Figure 14:
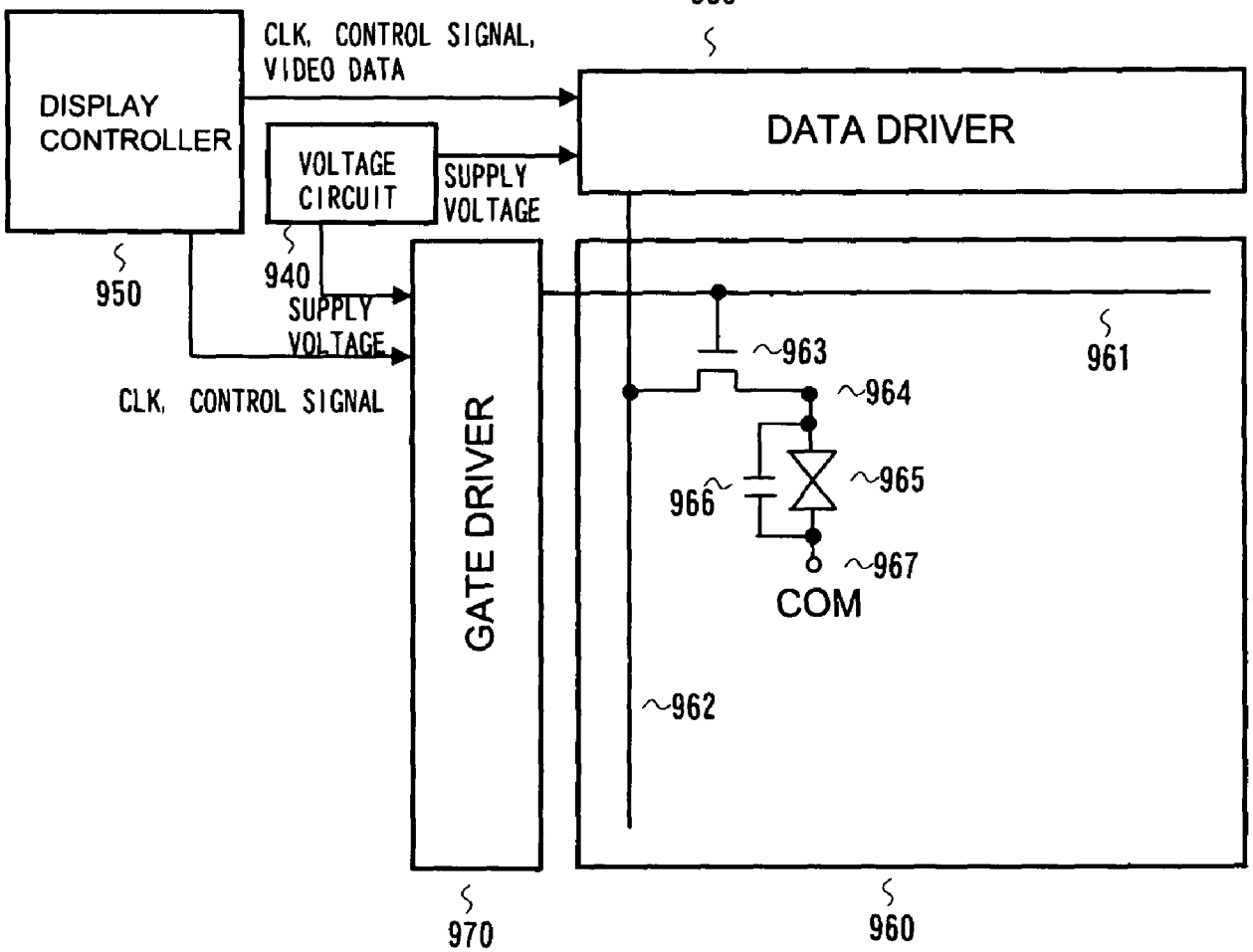
FIG. 14 is a diagram schematically showing a configuration of a liquid crystal display unit.

The output node 2 of the first output stage 110 is connected to an inverting input terminal (−) of the differential stage 100. A non-inverting input terminal (+) of the differential stage 100 is connected to an input terminal 1, and receives an input signal voltage Vin. The output node 3 of the second output stage 120 is connected to a load 90 (data line). Though no particular limitation is imposed on the invention, the output amplifier circuit in this exemplary embodiment drives a data line in a liquid crystal display panel, and the load 90 corresponds to a data line 962 in FIG. 14, for example. The switches SW10, SW11, and SW12 in FIG. 1A constitute a switch unit (connection control circuit) 510 that controls connection configurations of the output amplifier circuit, and are controlled to be turned on or off according to a control signal from the control signal generation circuit 500. Control over activation and deactivation of the second output stage 120 is controlled by the control signal from the control signal generation circuit 500.

Figure 1B:
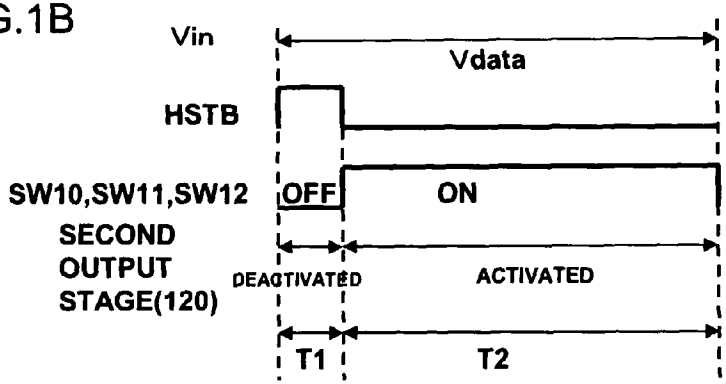

FIG. 1B is a timing waveform diagram showing operation of the circuit in FIG. 1A. A data period includes a time interval T1 immediately after a start of the data period, in which a signal HSTB is High and a time interval T2 after the time interval T1, in which the signal HSTB is Low. A data signal is switched at a timing when the signal HSTB is changed from Low to High, and the analog input signal Vin corresponding to subsequent data starts to be supplied to the output amplifier circuit. The time interval T1 in which the signal HSTB is High is set to a time interval in which the analog input signal Vin sufficiently transitions to a signal corresponding a current data from an analog signal corresponding to preceding data. In the time interval T2 in which the signal HSTB is Low, the load 90 is driven by an output signal amplified according to the analog input signal Vin.

The control signal generation circuit 500 causes the switches SW10, SW11, and SW12 to be turned off in the time interval T1, thereby activating the first output stage 110 and deactivating the second output stage 120. In the time interval T1, the second output stage 120 equivalently operates an output switch which is in an off state. With this arrangement, voltage supply from the output amplifier circuit to the load 90 is cut off, thereby preventing transmission of noise at a time of the transition of the input signal to the load 90. Further, in the time interval T1, the output 2 of the first output stage 110 is feed back connected to the inverting input terminal of the differential stage 100. Then, the differential stage 100 and the first output stage 110 constitute a voltage follower (non-inverting input type negative feedback amplifier with a gain=1), performs an amplifying operation in accordance with the input signal voltage Vin, and changes internal elements (such as a phase compensation capacitor) to a state corresponding to the input signal Vin. However, the switches SW10 are turned off. Thus, the output node 2 of the first output stage 110 is disconnected from the output node 3 (accordingly the load 90) of the second output stage 120.

The control signal generation circuit 500 causes the switches SW10, SW11, and SW12 to be turned on in the time interval T2 after the time interval T1, and connects the second output stage 120 to the differential stage 100, thereby activating the second output stage. In the time interval T2, the second output stage 120 drives the load 90. That is, in the time interval T2, the switches SW10 are turned on, the output node 3 of the second output stage 120 is feedback connected to the inverting input terminal of the differential stage 100, and the differential stage 100 and at least the second output stage 120 constitute a voltage follower, thereby driving the load 90 at high speed. The control signal generation circuit 500 may be ordinarily arranged outside the output amplifier circuit (refer to FIG. 13 which will be described later), the control signal generated by the control signal generation circuit 500 is wired to control terminals of the switches SW10, SW11, and SW12. Then, the switches SW10, SW11, and SW12 are thereby controlled to be turned on or off.

According to this exemplary embodiment, an on-resistance of an output switch is eliminated. Thus, a speed at which the output amplifier circuit drives the load 90 can be improved.

Further, this exemplary embodiment can reduce power dissipation and heat generation caused by the on-resistance of the output switch, due to deletion of the output switch.

Further, in the time interval T1 immediately after the start of the data period in this exemplary embodiment, the differential stage 100 and the first output stage 110 operate as the voltage follower according to the input voltage Vin supplied in the time interval T1 and changes the internal elements such as the phase compensation capacitance to a state corresponding to the input voltage Vin. With this arrangement, generation of output noise at a time of switching from the time interval T1 to the time interval T2 can be restrained. At the time of switching from the time interval T1 to the time interval T2, the switches SW10, SW11, and SW12 are switched from off to on, and then the second output stage 120 is thereby activated.

According to this exemplary embodiment, area saving can be implemented due to deletion of the output switch.

In this exemplary embodiment, the size of each of transistor elements in the first output stage 110, the switches SW10, SW11, and SW12 may be set to be small. Since the first output stage 110 operates as a sub-amplifier that drives the internal elements such as the phase compensation capacitance to a state corresponding to the input voltage Vin in the time interval T1. Thus, no driving capability is needed. Accordingly, the sizes of the transistor elements in the first output stage 110 can be reduced. The second output stage 120 operates as a main amplifier that substantially drives the load, in the time interval T2. The first output stage 110, together with the second output stage 120, may also drive the load 90 in the time interval T2. In an output amplifier circuit with an output switch, the size of the output switch is also set to be large for a large-capacitance data line load. In this exemplary embodiment, the output switch is eliminated. Then, in place of the output switch, the transistor elements in the first output stage 110, the switches SW10, SW11, and SW12 are added. The size of each of the elements is, however, set to be small. As a result, the area saving can be implemented.

Second Exemplary Embodiment

Figure 2A:
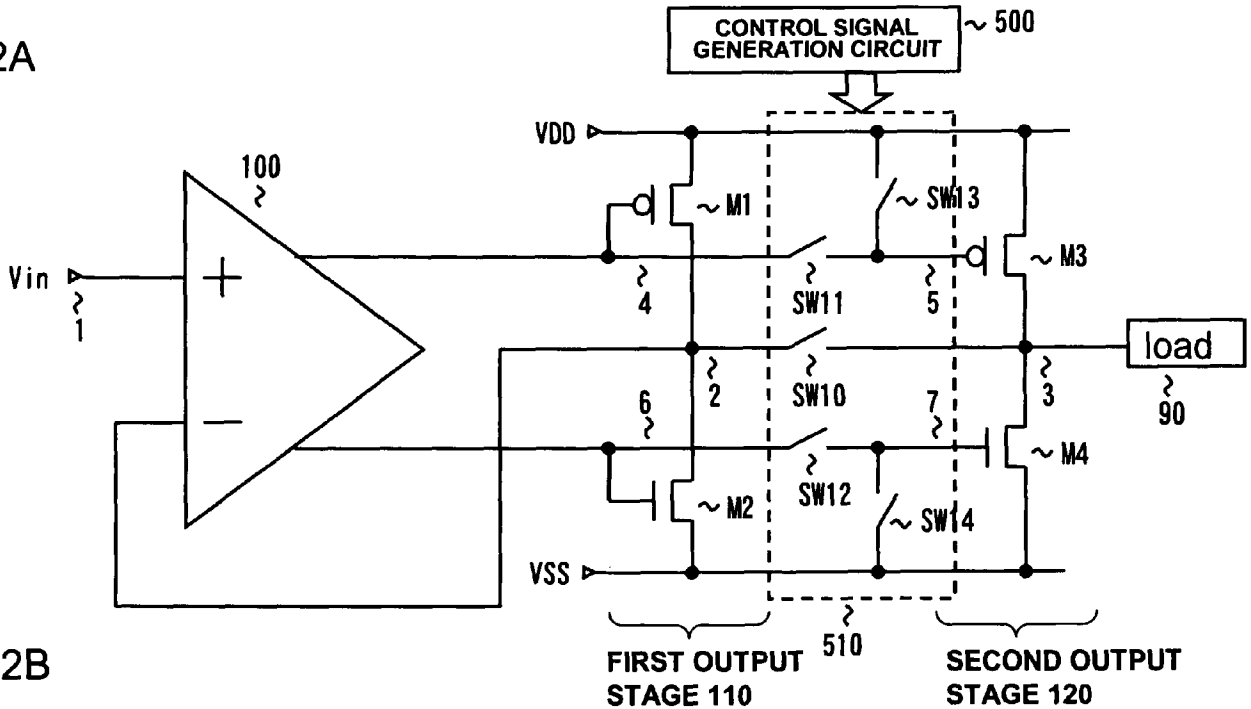
FIGS. 2A and 2B are diagrams respectively showing a configuration and control in a second exemplary embodiment of the present invention.

FIG. 2A is a diagram showing an example of a specific configuration of the first output stage 110 and the second output stage 120 in FIG. 1. The first output stage 110 includes a pMOS transistor M1 having a source thereof connected to a first power supply terminal (VDD) to which a power supply voltage VDD is supplied, a gate thereof connected to a first output 4 of a differential stage 100, and a drain thereof connected to an output node 2, and an nMOS transistor M2 having a source thereof connected to a second power supply terminal (VSS) to which a power supply voltage VSS is supplied, a gate thereof connected to a second output 6 of the differential stage 100, and a drain thereof connected to the output node 2. The second output stage 120 includes a pMOS transistor M3 having a source thereof connected to the first power supply terminal, a gate thereof connected to the first output 4 of the differential stage 100 through a switch SW11, and a drain thereof connected to an output node 3, and an nMOS transistor M4 having a source thereof connected to the second power supply terminal, a gate thereof connected to the second output 6 of the differential stage 100 through a switch SW12, and a drain thereof connected to the output node 3. In this exemplary embodiment, the differential stage 100 is so configured that the first output 4 and the second output 6 operate in a direction opposite to that of a voltage change of an input voltage Vin when the voltage of the input voltage Vin is changed.

A switch SW13 is connected between the first power supply terminal (VDD) and a gate 5 of the pMOS transistor M3. A switch SW14 is connected between the second power supply terminal (VSS) and a gate 7 of the nMOS transistor M4. A switch SW10 is connected between the output node 2 and the output node 3. Referring to FIG. 2A, the switches SW10 to SW14 constitute a switch unit (connection control circuit) 510, which is turned on or off by a control signal from a control signal generation circuit 500.

Figure 2B:
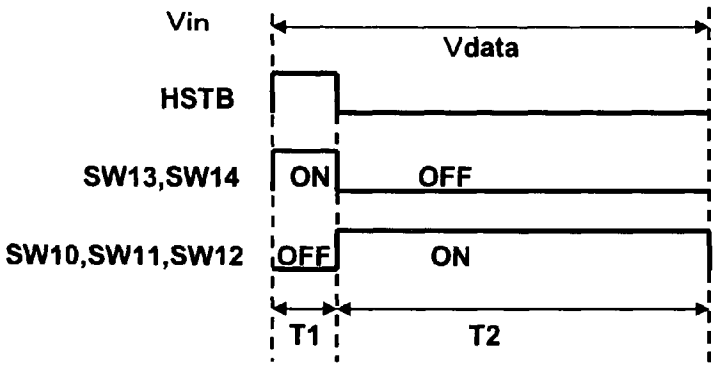

FIG. 2B is a diagram showing switching on or off of the switches SW10, SW11, SW12, SW13, and SW14 in a time interval T1 and a subsequent time interval T2 that constitute a data period. Timings of the data period T1 and T2 are set to be the same as those in FIG. 1B.

In the time interval T1 where a signal HSTB is High, the switches SW13 and SW14 are turned on, and the switches SW10, SW11, and SW12 are turned off. Since the switches SW13 and SW14 are turned on, potentials at the gates of the transistors M3 and M4 that constitute the second output stage 120 respectively assume power supply potentials VDD and VSS. Then, the transistors M3 and M4 are both turned off. The switches SW11 and SW12 are turned off, so that the gates of the transistors M3 and M4 that constitute the second output stage are electrically disconnected from the first output 4 and a second output 6 of the differential stage 100. Further, the switch SW10 is turned off, so that the output node 2 of the first output stage 110 is electrically disconnected from the output node 3 of the second output stage 120 connected to a data line load 90.

In the time interval T2 where the signal HSTB is Low, the switches SW13 and SW14 are turned off, and the switches SW10, SW11, and SW12 are turned on. Since the switches SW13 and SW14 are turned off, the gates of the transistors M3 and M4 that constitute the second output stage 120 are electrically disconnected from the power supply potentials VDD and VSS, respectively. Since the switches SW11 and SW12 are turned on, the gates of the transistors M3 and M4 are respectively connected to the first output 4 and the second output 6 of the differential stage 100. Since the switch SW10 is turned on, the output node 2 of the first output stage 110 is connected to the output node 3 of the second output stage, and to the load 90.

According to this exemplary embodiment, the output stage 110 operates as a sub-amplifier that drives internal elements such as a phase compensation capacitor to a state corresponding to the input voltage Vin in the time interval T1. Thus, driving capability is not always needed, and the size of each transistor element in the first output stage 110 may be set to be small. The second output stage 120 operates as a main amplifier that substantially drives the load in the time interval T2. In this exemplary embodiment, both of the first output stage 110 and the second output stage 120 drive the load 9 in the time interval T2.

In this exemplary embodiment, the size of each of the switches SW10 to SW14 may be set to be small. The element size of each of the first output stage 110 (M1, M2) and the second output stage 120 (M3, M4) is set to be optimal according to the load 90. The sizes of the first output stage 110 (M1, M2) and the second output stage 120 (M3, M4) may be set to be the same, for example. When area reduction is demanded, it is effective to increase the size of the second output stage 120 (M3, M4) that operates as the main amplifier and reduce the size of the first output stage 110 (M1, M2) that operates as the sub-amplifier. That is, the element size (W/L; in which W indicates a gate width, and L indicates a gate length) may be set as follows:

$$(W/L)M1, M2 \leqq (W/L)M3, M4$$

Especially when the W/L ratio of each of the transistors M1 and M2 in the first output stage 110 is set to be sufficiently small, compared with the W/L ratio of each of the transistors M3 and M4 in the second output stage 120, the first output stage 110 may also be so designed that no drain current is flown through each of the transistors M1 and M2 (or the transistors M1 and M2 are deactivated) in an output stable state. In this case, the transistors M1 and M2 in the first output stage 110 operate when a potential at the output node 2 of the first output stage 110 differs from an output voltage corresponding to the input signal Vin. When the potential at the output node 2 is in the vicinity of the output voltage corresponding to the input signal Vin, the transistors M1 and M2 are not operated (are deactivated).

Since a gate-to-source potential at each of the transistors M3 and M4 is zero at a start of the time interval T2, no noise is generated at a time of switching from the time interval T1 to the time interval T2. After the start of the time interval T2, the gates of the transistors M3 and M4 are quickly controlled by potentials at the first output 4 and the second output 6 of the differential stage 100, respectively, thereby driving the load 90 at high speed.

Third Exemplary Embodiment

Figure 3A:
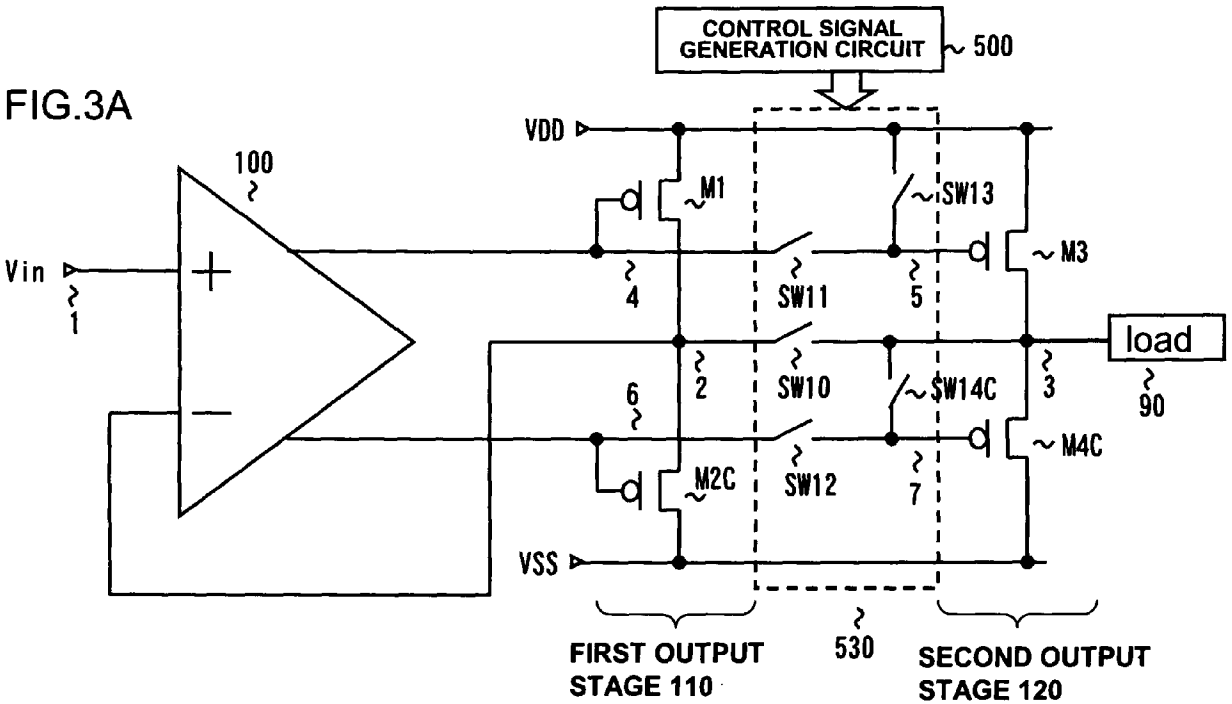
FIGS. 3A and 3B are diagrams respectively showing a configuration and control in a third exemplary embodiment of the present invention.

FIG. 3A is a diagram showing an example of another configuration of the first and second output stages 110 and 120 in FIG. 1. Referring to FIG. 3A, in this exemplary embodiment, the nMOS transistor M2 in the first output stage in FIG. 2A is constituted from a pMOS transistor M2C, the nMOS transistor M4 in the second output stage is constituted from a pMOS transistor M4C, and a switch SW14C is connected between a gate 7 and a source (output node 3 in a second output stage 120) of the pMOS transistor M4C. A differential stage 100 in this exemplary embodiment is so configured that a first output 4 operates in a direction opposite to that of a voltage change of an input voltage Vin and a second output 6 of the differential stage 100 operates in a same direction as that of the voltage change of the input voltage Vin when the voltage of the input voltage Vin is changed. Other configurations and switch switching are the same as those in the exemplary embodiment described above. In this exemplary embodiment, charging and discharging elements in the first and second output stages are both formed of pMOS transistors. Each of the MOS transistors M2C and M4C performs a source follower operation. Referring to FIG. 3A, switches SW10 to SW13 and the switch SW14C constitute a switch unit 530 and are controlled to be turned on or off according to a control signal from a control signal generation circuit 500. The switch SW14C may be connected between the gate 7 of the pMOS transistor M4C and a first power supply terminal (VDD).

Figure 3B:
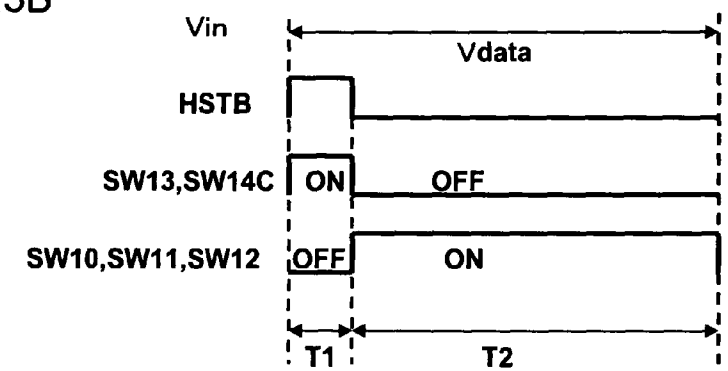

FIG. 3B is a diagram showing turning on or off of the switches SW10, SW11, SW12, SW13, and SW14C in a time interval T1 and a subsequent time interval T2 that constitute a data period. Timing settings in the time intervals T1 and T2 are the same as those in FIG. 1B.

In the time interval T1 in which a signal HSTB is High, the switches SW13 and SW14C are turned on, and the switches SW10, SW11, and SW12 are turned off. Since the switches SW13 and SW 14C are turned on, gate-to-source potentials of a pMOS transistor M3 and the pMOS transistor M4C that constitute the second output stage 120 are made zero. Both of the pMOS transistors M3 and M4C are thereby turned off.

In the time interval T2 in which the signal HSTB is Low, the switches SW13 and SW14C are turned off, and the switches SW10, SW11, and SW12 are turned on. Since the switches SW13 and SW14C are turned off, a gate of the pMOS transistor M3 and the gate of the pMOS transistor M4C that constitute the second output stage are electrically disconnected from sources thereof. Then, since the switches SW11 and SW12 are turned on, the gates of the transistors M3 and M4C are respectively connected to the first output 4 and the second output 6 of the differential stage 100. Further, since the switch SW10 is turned on, an output node 2 of the first output stage is connected to an output node 3 of the second output stage 120, and is then connected to a load 90.

According to this exemplary embodiment, in the first output stage 110 and the second output stage 120, the elements that discharge the output nodes 2 and 3 are respectively constituted from the pMOS transistors M2C and M4C. For this reason, an operating range of an output amplifier circuit in this exemplary embodiment is narrowed just by an absolute value Vtp of the threshold voltage of each of the pMOS transistors M2C and M4C on a low-potential side supply voltage VSS, compared with a supply voltage range (VDD to VSS). Thus, the operating range of the output amplifier circuit is set to be approximately from VDD to (VSS+Vtp). In this exemplary embodiment, though the operating range of the output amplifier circuit is slightly narrowed, the configuration of the differential stage 100 can be simplified. A configuration example of the output amplifier circuit in this exemplary embodiment will be described with reference to FIG. 12, which will be described later.

Fourth Exemplary Embodiment

Figure 4A:
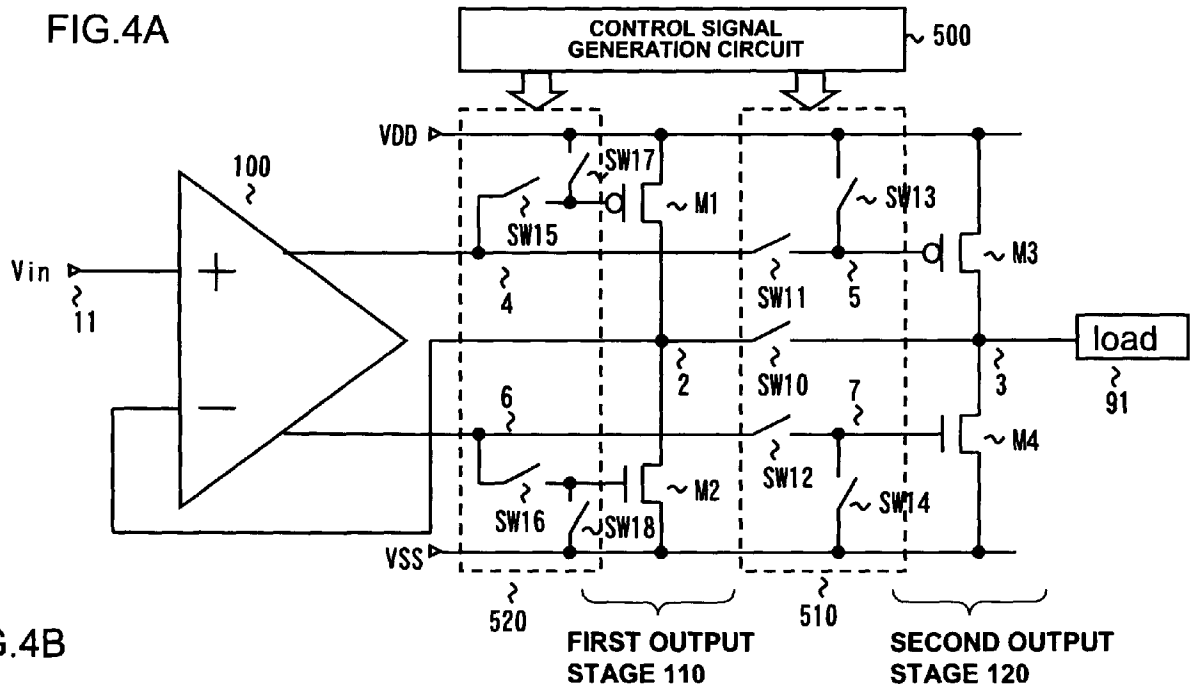
FIGS. 4A and 4B are diagrams respectively showing a configuration and control in a fourth exemplary embodiment of the present invention.

FIG. 4A is a diagram showing an example of a specific configuration of the first output stage 110 and the second output stage 120 in FIG. 1. Referring to FIG. 4A, this exemplary embodiment includes a switch SW15 between the gate of the pMOS transistor M1 in the first output stage and the first output 4 of the differential stage 100 in FIG. 2A, and a switch SW17 between the gate of the pMOS transistor M1 and the first power supply terminal (VDD) in FIG. 2A. A switch SW16 is included between the gate of the nMOS transistor M2 in the first output stage and the second output 6 of the differential stage 100, and a switch SW18 is included between the gate of the nMOS transistor M2 and the second power supply terminal (VSS). Switches SW10, SW11, SW12, SW13, and SW14 constitute a switch unit 510, and the switches SW15, SW16, SW17, and SW18 constitute a switch unit 520. The switches SW10 to SW18 are controlled to be turned on or off according to a control signal from a control signal generation circuit 500. The differential stage 100 is configured so that each of the first output 4 and the second output 6 operate in a direction opposite to that of a voltage change of an input voltage Vin when the voltage of the input voltage Vin is changed.

Figure 4B:
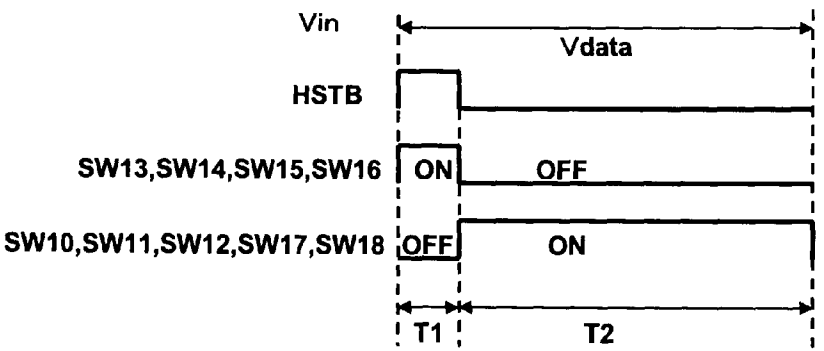

FIG. 4B is a diagram showing turning on or off of the switches SW10, SW11, SW12, SW13, SW14, SW15, SW16, SW17, and SW18 in a time interval T1 and a subsequent time interval T2 that constitute a data period. A first group of the switches constituted from the switches SW13, SW14, SW15, and SW16 are commonly turned on or off and a second group of the switches constituted from the switches SW10, SW11, SW12, SW17, and SW18 are commonly and complementarily turned on or off relative to the first group of switches.

More specifically, in the time interval T1 in which a signal HSTB is High, the switches SW13, SW14, SW15, and SW16 are turned on, and the switches SW10, SW11, SW12, SW17, and SW18 are turned off. Since the switches SW13 and SW14 are turned on, potentials at gates of a pMOS transistor M3 and an nMOS transistor M4 that constitute a second output stage 120 respectively assume power supply potentials VDD and VSS, and are both turned off. Since the switches SW15 and SW16 are turned on, the pMOS transistor M1 and the nMOS transistor M2 in the first output stage are respectively connected to the first output 4 and the second output 6 in the differential stage 100. The switches SW11 and SW12 are turned off, so that gates of transistors M3 and M4 that constitute the second output stage are electrically disconnected from the first output 4 and the second output 6, respectively, in the differential stage 100. Further, the switch SW10 is turned off, so that an output node 2 of a first output stage 110 is electrically disconnected from an output node 3 of the second output stage 120 connected to a data line load 90.

In the time interval T2 in which the signal HSTB is Low, the switches SW13, SW14, SW15, and SW16 are turned off, and the switches SW10, SW11, SW12, SW17, and SW18 are turned on. Since the switches SW13 and SW14 are turned off, the gates of the transistors M3 and M4 that constitute the second output stage 120 are electrically disconnected from the supply potentials VDD and VSS, respectively. Since the switches SW11 and SW12 are turned on, the gates of the transistors M3 and M4 are respectively connected to the first output 4 and the second output 6 of the differential stage 100. Further, since the switch SW10 is turned on, the output node 2 of the first output stage is connected to the output node 3 of the second output stage 120 connected to the data line load 90. Since the switches SW15 and SW16 are turned off and the switches SW17 and SW18 are turned on, the gates of the pMOS transistor M1 and the nMOS transistor M2 in the first output stage 110 are disconnected from the first output 4 and the second output 6 of the differential stage 100, respectively, and are connected to the supply potentials VDD and VSS, respectively. The pMOS transistor M1 and the nMOS transistor M2 are thereby turned off (which means that in the time interval T2, the first output stage 110 is deactivated).

According to this exemplary embodiment, the first output stage 110 operates as a sub-amplifier that drives internal elements such as a phase compensation capacitor to a state corresponding to the input voltage Vin in the time interval T1. Thus, driving capability is not always needed. Thus, the size of each transistor element in the first output stage 110 may be set to be small. The second output stage 120 operates as a main amplifier that substantially drives the load in the time interval T2. In this exemplary embodiment, the first output stage 110 is deactivated, and the second output stage 120 drives the load 90, in the time interval T2. The switches SW15 and SW17 that control turning on or off of the pMOS transistor M1 in the first output stage 110 may be replaced by other switch connected to the pMOS transistor M1 in series between the first power supply terminal (VDD) and the node 2. Likewise, the switches SW16 and SW18 that control turning on or off of the nMOS transistor M2 in the first output stage 110 may be replaced by other switch connected to the nMOS transistor M2 in series between the second power supply terminal (VSS) and the node 2.

Fifth Exemplary Embodiment

Figure 5:
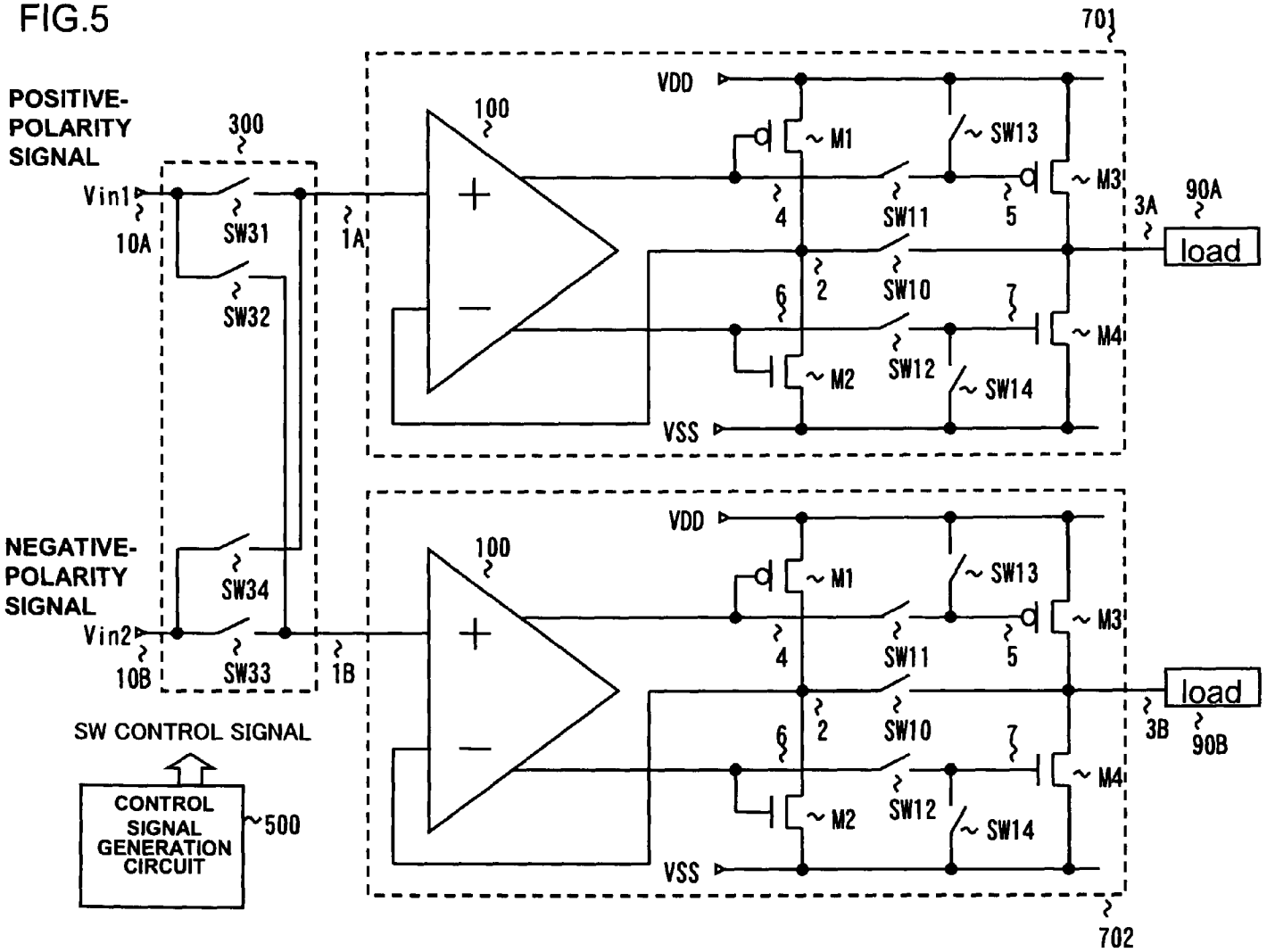
FIG. 5 is a diagram showing a configuration and control in a fifth exemplary embodiment of the present invention.

FIG. 5 is a diagram showing a configuration of another exemplary embodiment of the present invention. FIG. 5 shows an example of the configuration of a two-output amplifier circuit for liquid crystal driving. In this exemplary embodiment, adjacent two outputs are set to have different polarities. In this exemplary embodiment, an output switch that switches either one of straight connection or cross connection among an output node 3A of an output amplifier circuit 701, an output node 3B of an output amplifier circuit 702, and loads 90A and 90B is not provided. An input switching circuit 300 is provided to switch polarities of the two output nodes 3A and 3B. According to this exemplary embodiment, there is no output switch. Thus, together with improvement in a driving speed, reduction of power to be consumed by the output switch and heat generation at the output switch can be achieved.

The input switching circuit 300 includes a switch SW31 connected between a positive-polarity signal input terminal 10A and an input 1A to a differential stage 100 of the output amplifier circuit 701, a switch SW32 connected between the positive-polarity signal input terminal 10A and an input 1B to the differential stage 100 of the output amplifier circuit 702, a switch SW33 connected between a negative-polarity input terminal 10B and an input 1B to a differential stage 100 of the output amplifier circuit 702, and a switch SW34 connected between the negative-polarity input terminal 10B and an input 1A to the differential stage 100 of the output amplifier circuit 701. A control signal generation circuit 500 generates a control signal that controls turning on and off of the switches SW31 to SW34. When the switches SW31 and SW33 are turned on, a positive-polarity signal Vin1 and a negative-polarity signal Vin2 are respectively supplied to differential stages 100 of the output amplifier circuits 701 and 702 (which is referred to as straight connection), and output signals corresponding to the signals Vin1 and Vin2 are respectively output to loads 90A and 90B through output terminals 3A and 3B. When the switches SW32 and SW34 are turned on, the positive-polarity signal Vin1 and the negative-polarity signal Vin2 are respectively supplied to the differential stages 100 of the output amplifier circuits 702 and 701 (which is referred to as cross connection), and the output signals corresponding to the signals Vin1 and Vin2 are respectively output to the loads 90B and 90A through the output terminals 3B and 3A.

Though no particular limitation is imposed, each of the output amplifier circuits 701 and 702 in the exemplary embodiment in FIG. 5 has the configuration described with reference to FIG. 2. Alternatively, the circuit in FIG. 4 may be applied.

Figure 6A:
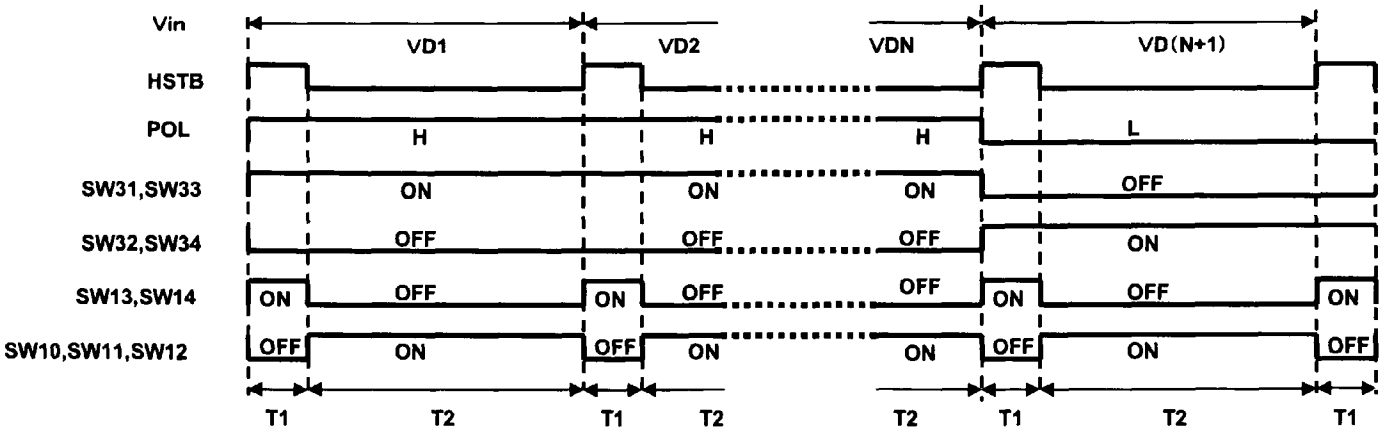
FIGS. 6A and 6B are diagrams respectively showing control in the fifth exemplary embodiment of the present invention.
Figure 6B:
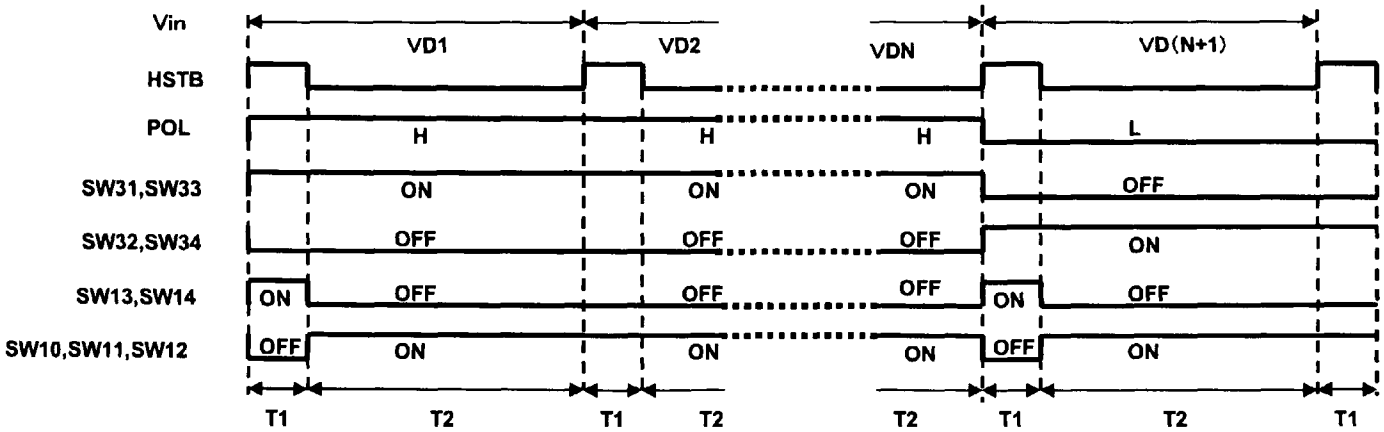

FIGS. 6A and 6B are diagrams each showing control over each switch when polarity inversion is performed in the circuit in FIG. 5 for each N data periods (in which N is an integer not less than 1) (the polarity inversion being performed at starts of data periods VD1 and VD (N+1)). When the data periods VD1 and VD (N+1) are started, turning on/off of a pair of the switches SW31 and SW33 and a pair of the switches SW32 and SW34 in the input switching circuit 300 is switched.

In the example shown in FIG. 6A, turning on/off of the switches SW31 to SW34 in the input switching circuit 300 is switched for each polarity inversion. A second output stage (M3, M4) of each of the output amplifier circuits 701 and 702 is set to be deactivated in a time interval T1 immediately after the start of each data period, irrespective of the polarity inversion. That is, in the time interval T1 of each of the data periods VD1, data periods VD2 to VD (N), and the data period VD (N+1), the switches SW13 and SW14 are turned on, and the switches SW10, SW11, and SW12 are turned off. The second output stage (M3, M4) of each of the output amplifier circuits 701 and 702 is thereby deactivated.

In the example shown in FIG. 6B, the second output stage (M3, M4) of each of the output amplifier circuits 701 and 702 is deactivated in the first time intervals T1 of the data periods (VD1, VD (N+1)) after the polarity inversion (after transition of a polarity signal POL).

In switching of data periods when a same polarity is continued (or when the polarity signal POL is continuously High or Low), the second output stage (M3, M4) remains to be activated throughout the data periods. That is, in the time interval T1 of the data period in which the polarity signal POL has the same level as in the preceding data period, the switches SW13 and SW14 are turned off, and the switches SW10, SW11, and SW12 are kept to be turned on, as in the time interval T2. For this reason, a starting point of time of driving the data line loads 90A and 90B by the second output stages (M3, M4) gets earlier though transition noise may be transmitted to each of the data line loads 90A and 90B. Thus, the output amplifier circuit in this exemplary embodiment is suitable for large-screen (large-capacitance load) driving, 120 Hz driving (in which one data period is halved) where a driving frequency is doubled to improve moving picture characteristics, and the like. That is, in the data period in which the polarity of a driving voltage is the same as in the preceding data period, the data line loads 90A and 90B are driven at high speed by the second output stages (M3, M4) in an activated state, from the first time interval.

Sixth Exemplary Embodiment

Next, a sixth exemplary embodiment of the present invention will be described. This exemplary embodiment shows a configuration of a two-output amplifier circuit for liquid crystal driving (which is an example when two outputs have different polarities). Polarities of input signals supplied to respective output amplifier circuits are fixed. FIG. 7 is a diagram showing the configuration of this exemplary embodiment.

Figures 7A, 7B, 7C, 7D:
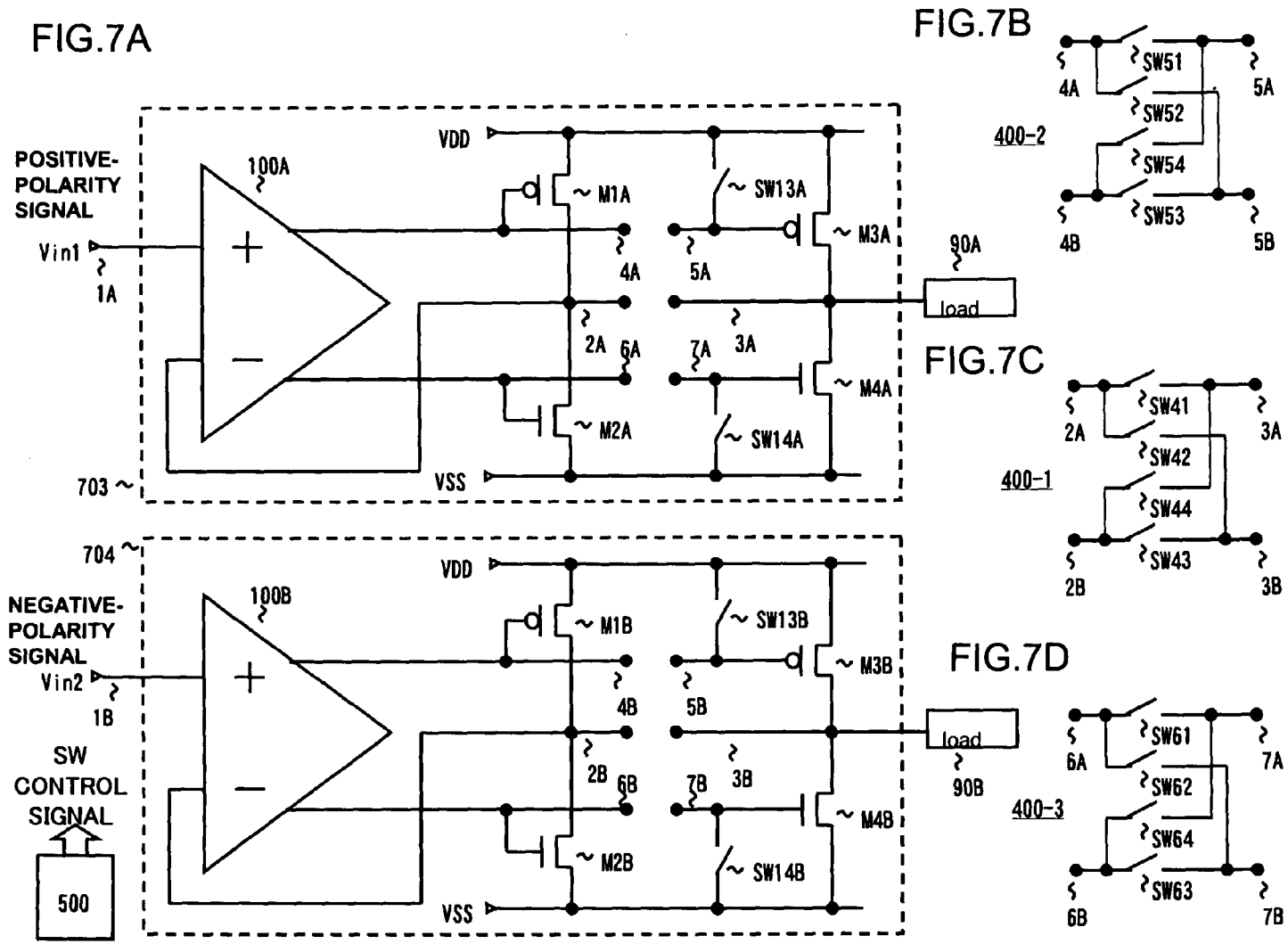
FIG. 7 is a diagram showing a configuration and control in a sixth exemplary embodiment of the present invention, respectively.

Referring to FIG. 7A, in this exemplary embodiment, the input switching circuit 300 in the fourth exemplary embodiment is eliminated. Then, a positive-polarity signal Vin1 and a negative-polarity signal Vin2 are directly supplied to output amplifier circuits 703 and 704, respectively. Since the polarities of the input signals are fixed, output switching circuits 400-1 to 400-3 are provided, thereby switching the polarities of two outputs. Each of the output amplifier circuits 703 and 704 has the configuration in FIG. 2.

Referring to FIG. 7C, the output switching circuit 400-1 performs switching control of connection between each of an output node 2A of a first output stage (M1A, M2A) of the output amplifier circuit 703 and an output node 2B of a first output stage (M1B, M2B) of the output amplifier circuit 704 and each of an output node 3A of a second output stage (M3A, M4A) of the output amplifier circuit 703 and an output node 3B of a second output stage (M3B, M3B) of the output amplifier circuit 704 to either one of straight connection or cross connection.

More specifically, the output switching circuit 400-1 includes a switch SW41 between the node 2A and the node 3A, a switch SW42 between the node 2A and the node 3B, a switch SW44 between the node 2B and the node 3A, and a switch SW43 between the node 2B and the node 3B. When the switches SW41 and SW43 are turned on, the nodes 2A and 3A are connected, and the nodes 2B and 3B are connected (which is the straight connection). When the switches SW42 and SW44 are turned on, the nodes 2A and 3B are connected, and the nodes 2B and 3A are connected (which is the cross connection).

Referring to FIG. 7B, the output switching circuit 400-2 performs switching control of connection between each of a first output 4A of a differential stage 100A of the output amplifier circuit 703 and a first output 4B of a differential stage 100B of the output amplifier circuit 704 and each of a gate node 5A of the transistor M3A in the second output stage (M3A, M4A) of the output amplifier circuit 703 and a gate node 5B of the transistor M3B of the second output stage (M3B, M3B) of the output amplifier circuit 704 to either one of straight connection or cross connection.

More specifically, the output switching circuit 400-2 includes a switch SW51 between a node 4A and the node 5A, a switch SW52 between the node 4A and the node 5B, a switch SW54 between a node 4B and the node 5A, and a switch SW53 between the node 4B and the node 5B. When the switches SW51 and SW53 are turned on, the nodes 4A and 5A are connected, and the nodes 4B and 5B are connected (which is the straight connection). When the switches SW52 and SW54 are turned on, the nodes 4A and 5B are connected, and the nodes 4B and 5A are connected (which is the cross connection).

Referring to FIG. 7D, the output switching circuit 400-3 performs switching control of connection between each of a second output 6A of the differential stage 100A of the output amplifier circuit 703 and a second output 6B of the differential stage 100B of the output amplifier circuit 704 and each of a gate node 7A of the transistor M4A of the second output stage (M3A, M4A) of the output amplifier circuit 703 and a gate node 7B of the transistor M4B of the second output stage (M3B, M4B) of the output amplifier circuit 704 to either one of straight connection or cross connection.

More specifically, the output switching circuit 400-3 includes a switch SW61 between a node 6A and the node 7A, a switch SW62 between the node 6A and the node 7B, a switch SW64 between a node 6B and the node 7A, and a switch SW63 between the node 6B and the node 7B. When the switches SW61 and SW63 are turned on, the nodes 6A and 7A are connected, and the nodes 6B and 7B are connected (which is the straight connection). When the switches SW62 and SW64 are turned on, the nodes 6A and 7B are connected, and the nodes 6B and 7A are connected (which is the cross connection).

When the straight connection is made for each of the output switching circuits 400-1, 400-2, and 400-3, a load 90A connected to the output node 3A of the output amplifier circuit 703 is driven by the output amplifier circuit 703 that receives the positive-polarity signal Vin1. A load 90B connected to the output node 3B of the output amplifier circuit 704 is driven by the output amplifier circuit 704 that receives the negative-polarity signal Vin2.

When the cross connection is made for each of the output switching circuits 400-1, 400-2, and 400-3, the load 90A connected to the output node 3A of the output amplifier circuit 703 is driven by the second output stage (M3A, M4A) of the output amplifier circuit 703 that receives the outputs of the differential stage 100B of the output amplifier circuit 704 that receives the negative-polarity signal Vin2. The load 90B connected to the output 3B of the output amplifier circuit 704 is driven by the second output stage (M3B, M4B) of the output amplifier circuit 704 that receives the outputs of the differential stage 100A of the output amplifier circuit 703 that receives the positive-polarity signal Vin1.

In this exemplary embodiment, each of the differential stage 100A of the output amplifier circuit 703 and the differential stage 100B of the output amplifier circuit 704 may be a Rail-to-Rail configuration including both of an nMOS differential pair and a pMOS differential pair. Alternatively, each of the differential stage 100A of the output amplifier circuit 703 and the differential stage 100B of the output amplifier circuit 704 may be a configuration including a differential pair of one of the two polarities. In this case, the differential stage 100A of the output amplifier circuit 703 includes an nMOS differential pair, while the differential stage 100B of the output amplifier circuit 704 includes a pMOS differential pair. With this arrangement, Rail-to-Rail driving of the loads 90A and 90B (full-range driving within the power supply voltage range) can be performed.

Figure 8A:
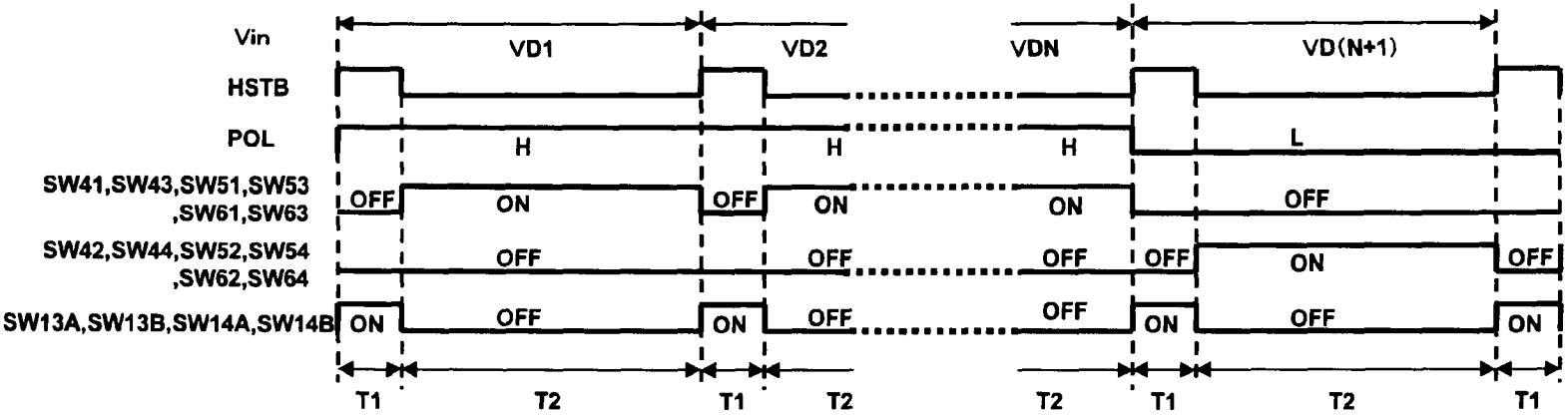
FIGS. 8A and 8B are diagrams respectively showing control in the sixth exemplary embodiment of the present invention.
Figure 8B:
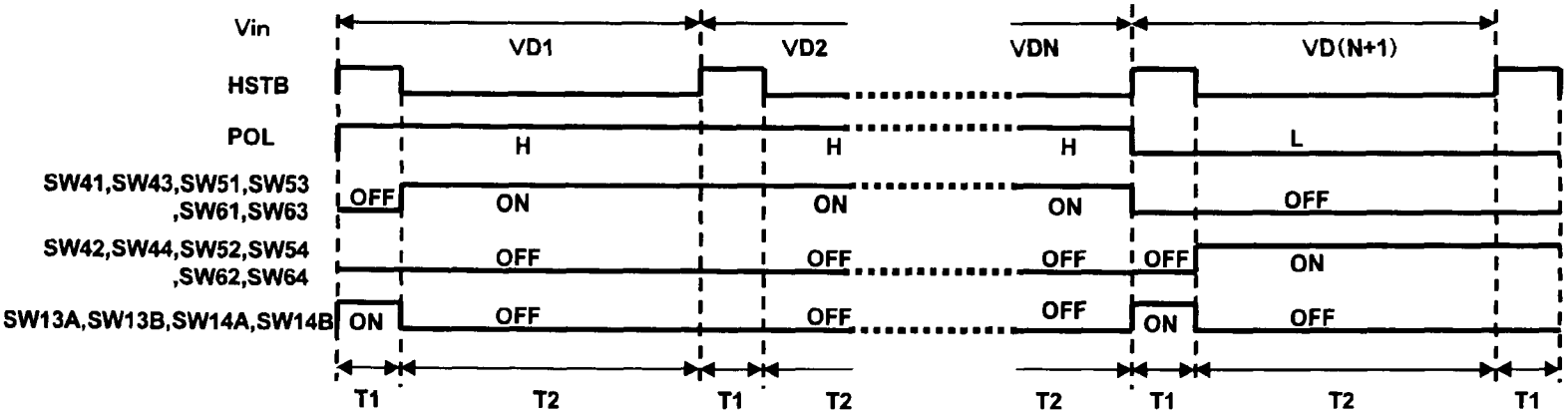

FIGS. 8A and 8B are diagrams each showing a control example over each switch when polarity inversion is performed for each N data periods (in which N is an integer not less than 1) (with the polarity inversion performed at starts of data periods VD1 and VD(N+1)) in the circuit in FIG. 7. In the example shown in FIG. 8A, when a polarity signal POL is High, the switches SW41, SW43, SW51, SW53, SW61, and SW63 in the output switching circuits 400-1 to 400-3 in FIG. 7 are turned off in a time interval T1 immediately after the start of each data period, and turned on in a time interval T2 (in the case of straight connection). Then, in the time interval T2, the loads 90A and 90B are respectively driven based on the positive-polarity signal Vin1 and the negative-polarity signal Vin2.

When the polarity signal POL is High, the switches SW42, SW44, SW52, SW54, SW62, and SW64 in the output switching circuits 400-1 to 400-3 in FIG. 7 are turned off in both of the time intervals T1 and T2 in each data period.

When the polarity signal POL is Low, the switches SW42, SW44, SW52, SW54, SW62, and SW64 in the output switching circuits 400-1 to 400-3 in FIG. 7 are turned off in the time interval T1 and are turned on in the time interval T2, in each data period (in the case of cross connection). In the time interval T2, the loads 90A and 90B are respectively driven, based on the negative-polarity signal Vin2 and the positive-polarity signal Vin1.

When the polarity signal POL is Low, the switches SW41, SW43, SW51, SW53, SW61, and SW63 in the output switching circuits 400-1 to 400-3 in FIG. 7 are turned off in both of the time intervals T1 and T2 in each data period.

As in FIG. 6A, the switches SW13A, SW14A, SW13B, and SW14B in the output amplifier circuits 703 and 704 are turned on in the time interval T1 and turned off in the time interval T2, in each data period. With this arrangement, the second output stage of each output amplifier circuit is deactivated in the time interval T1 of each data period, irrespective of the polarity inversion.

In the example shown in FIG. 8B, the switches SW41, SW43, SW51, SW53, SW61, and SW63 in the output switching circuits 400-1, 400-2, and 400-3 in FIG. 7 are turned off in the time interval T1 of the first data period (VD1) in which the polarity signal POL has been switched from Low to High, and are turned on in the time interval T2. In data periods (VD2 to VDN) other than the first data period VD1, in which the polarity signal POL is High, the switches SW41, SW43, SW51, SW53, SW61, and SW63 in the output switching circuits 400-1 to 400-3 are turned on.

The switches SW42, SW44, SW52, SW54, SW62, and SW64 in the output switching circuits 400-1, 400-2, and 400-3 in FIG. 7 are turned off in both of the time intervals T1 and T2 in the data periods (VD1 to VDN) in which the polarity signal POL is High.

The switches SW42, SW44, SW52, SW54, SW62, and SW64 in the output switching circuits 400-1, 400-2, and 400-3 in FIG. 7 are kept off in the time interval T1 of the first data period (VD (N+1)) in which the polarity signal POL has been switched from High to Low, and are turned on in the time interval T2. In the data period other than the data period (VD(N+1)), in which the polarity signal POL is Low, the switches SW42, SW44, SW52, SW54, SW62, and SW64 in the output switching circuits 400-1, 400-2, and 400-3 are turned on.

In the data period where the polarity signal POL is Low, the switches SW41, SW43, SW51, SW53, SW61, and SW63 in the output switching circuits 400-1, 400-2, and 400-3 in FIG. 7 are turned off in both of the time intervals T1 and T2.

The switches SW13A and SW14A in the output amplifier circuit 703 and the switches SW13B and SW14B in the output amplifier circuit 704 are turned on in the time interval T1 and are turned off in the time interval T2 in the first data periods (VD1, VD(N+1)) after the polarity inversion. Then, the switches SW13A, SW14A, SW13B, and SW14B are turned off in the data periods other than the time intervals VD1 and VD(N+1). Referring to FIG. 8B, in the data period where the polarity of a driving voltage is the same as that in the preceding time interval, the loads 90A and 90B of data lines are driven by the second output stage (M3, M4) in an activated state at high speed from the first time interval, as in FIG. 6B. For this reason, the output amplifier circuit in this exemplary embodiment is suitable for driving a large screen (large-capacitance load), double-speed (120 Hz) driving, and the like.

Seventh Exemplary Embodiment

Figure 9:
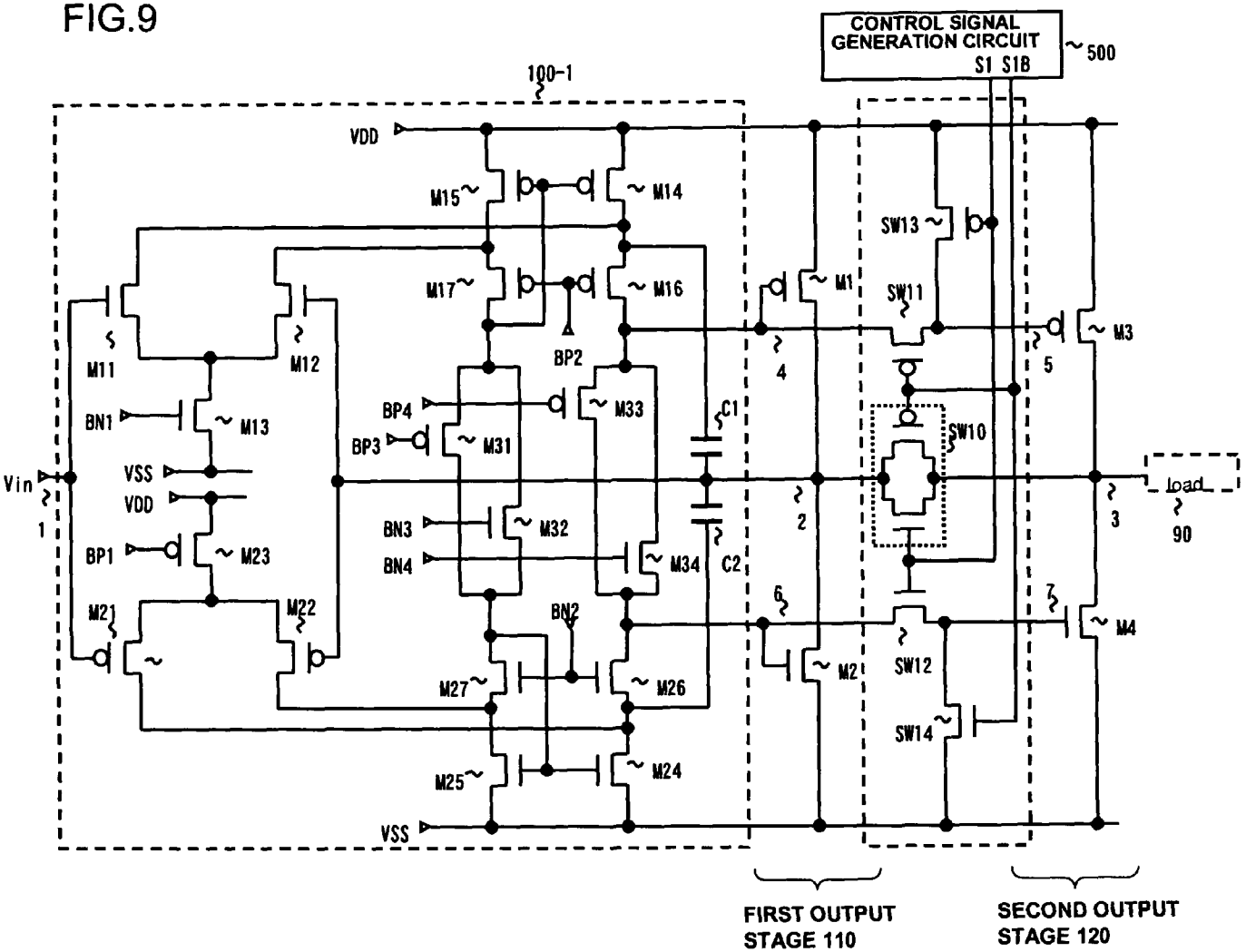
FIG. 9 is a diagram showing a configuration of a seventh exemplary embodiment of the present invention.

FIG. 9 shows an example of a configuration illustrating each of the output amplifier circuit in FIG. 2A, the output amplifier circuits 701 and 702 in FIG. 5, and the output amplifier circuits 703 and 704 in FIG. 7. This exemplary embodiment is set to a Rail-to-Rail amplifier configuration. A differential stage 100-1 includes a folded-cascode current mirror and a floating current source. With respect to the differential stage 100-1, a description in FIG. 1 in Patent Document 4(JP Patent Kokai Publication No. JP-A-6-326529) is referred to.

The differential stage 100-1 includes an nMOS transistor M13 (current source) having a source thereof connected to a power supply VSS and nMOS transistors M11 and M12 (nMOS differential pair) with a commonly connected source thereof connected to a drain of the nMOS transistor M13; and a pMOS transistor M23 (current source) having a source thereof connected to a power supply VDD and pMOS transistors M21 and M22 (pMOS differential pair) with a commonly connected source thereof connected to a drain of pMOS transistor M23. A gate of the nMOS transistor M13 receives a bias voltage BN1. A gate of the pMOS transistor M23 receives a bias voltage BP1. Gates of the transistors M11 and M21 are connected in common to an input terminal 1. Gates of the transistors M12 and M22 are connected in common to an output node 2 of a first output stage 110.

The differential stage 100-1 includes pMOS transistors M14 and M15 having sources thereof connected to the power supply VDD, and gates thereof connected in common and pMOS transistors M16 and M17 having sources thereof respectively connected to drains of the pMOS transistors M14 and M15 and gates thereof connected in common. The gates of the pMOS transistors M16 and M17 receive a bias voltage BP2. A drain of the transistor M17 is connected to the common gate of the transistors M14 and M15. Drains of the transistors M11 and M12 that forms the nMOS differential pair are respectively connected to the drains of the pMOS transistors M14 and M15. The pMOS transistors M14, M15, M16, and M17 form a first cascode current mirror.

The differential stage 100-1 includes nMOS transistors M24 and M25 having sources thereof connected to the power supply VSS, and gates thereof connected in common and nMOS transistors M26 and M27 having sources thereof respectively connected to drains of the nMOS transistors M24 and M25 and gates thereof connected in common. The gates of the nMOS transistors M26 and M27 receive the bias voltage BN2. A drain of the transistor M27 is connected to the common gate of the transistors M24 and M25. Drains of the transistors M21 and M22 that form the pMOS differential pair are respectively connected to the drains of the nMOS transistors M24 and M25. The nMOS transistors M24, M25, M26, and M27 form a second cascode current mirror.

The differential stage 100-1 includes:

a pMOS transistor M31 and an nMOS transistor M32 (floating current source) connected between the drains of the pMOS transistor M17 and the nMOS transistor M27; and a pMOS transistor M33 and an nMOS transistor M34 (floating current source) connected between drains of the pMOS transistor M16 and the nMOS transistor M26. Gates of the pMOS transistor M31 and the nMOS transistor M32 respectively receive bias voltages BP3 and BN3. Gates of the pMOS transistor M33 and the nMOS transistor M34 respectively receive bias voltages BP4 and BN4.

The drain of the pMOS transistor M16 is set to a first output node 4 of the differential stage 100-1. The drain of the nMOS transistor M26 is set to a second output node 6 of the differential stage 100-1. A first output 4 and a second output 6 in the differential stage 100-1 respectively operate in a direction opposite to that of a voltage change of an input voltage Vin when the voltage of the input voltage Vin is changed.

The first output stage 110 includes a pMOS transistor M1 and an nMOS transistor M2. A second output stage 120 includes a pMOS transistor M3 and an nMOS transistor M4. A capacitance (phase compensation capacitance) C1 is connected between the output node 2 of the first output stage 110 and the source of the pMOS transistor M16 (which is also an output of the nMOS differential pair). A capacitance (phase compensation capacitance) C2 is connected between the output node 2 of the first output stage 110 and a source of the nMOS transistor M26 (which is also an output of the pMOS differential pair). The capacitances C1 and C2 perform phase compensating operations on the first output stage 110 and the second output stage 120, respectively.

A switch SW10 between the output node 2 of the first output stage 110 and an output node 3 of the second output stage 120 includes a CMOS transfer gate. A control signal S1 is supplied to the gate of the nMOS transistor, and a complementary signal S1B of the control signal S1 is supplied to the pMOS transistor. When the control signal S1 is High, the switch SW10 is turned on. The signals S1 and S1B are generated by a control signal generation circuit 500 and are control signals that control the switch SW10 and switches SW11 to SW14.

The switch SW11 between a first output 4 of the differential stage 100-1 and a gate 5 of the transistor M3 of the second output stage 120 includes a pMOS transistor. To a gate of the switch SW11, the control signal S1B is connected.

The switch SW12 between a second output 6 of the differential stage 100-1 and a gate 7 of the transistor M4 of the second output stage 120 includes an nMOS transistor. To a gate of the switch SW12, the control signal S1 is connected.

Since on/off control over the switches SW10, SW11, SW12, SW13, and SW14 in FIG. 9 is as shown in FIG. 2B for the output amplifier circuit in FIG. 2A, FIGS. 6A and 6B for the output amplifier circuits 701 and 702 in FIG. 5, and FIGS. 8A and 8B for the output amplifier circuits 703 and 704 in FIG. 7, a description of the on/off control will be omitted.

Eighth Exemplary Embodiment

Figure 10:
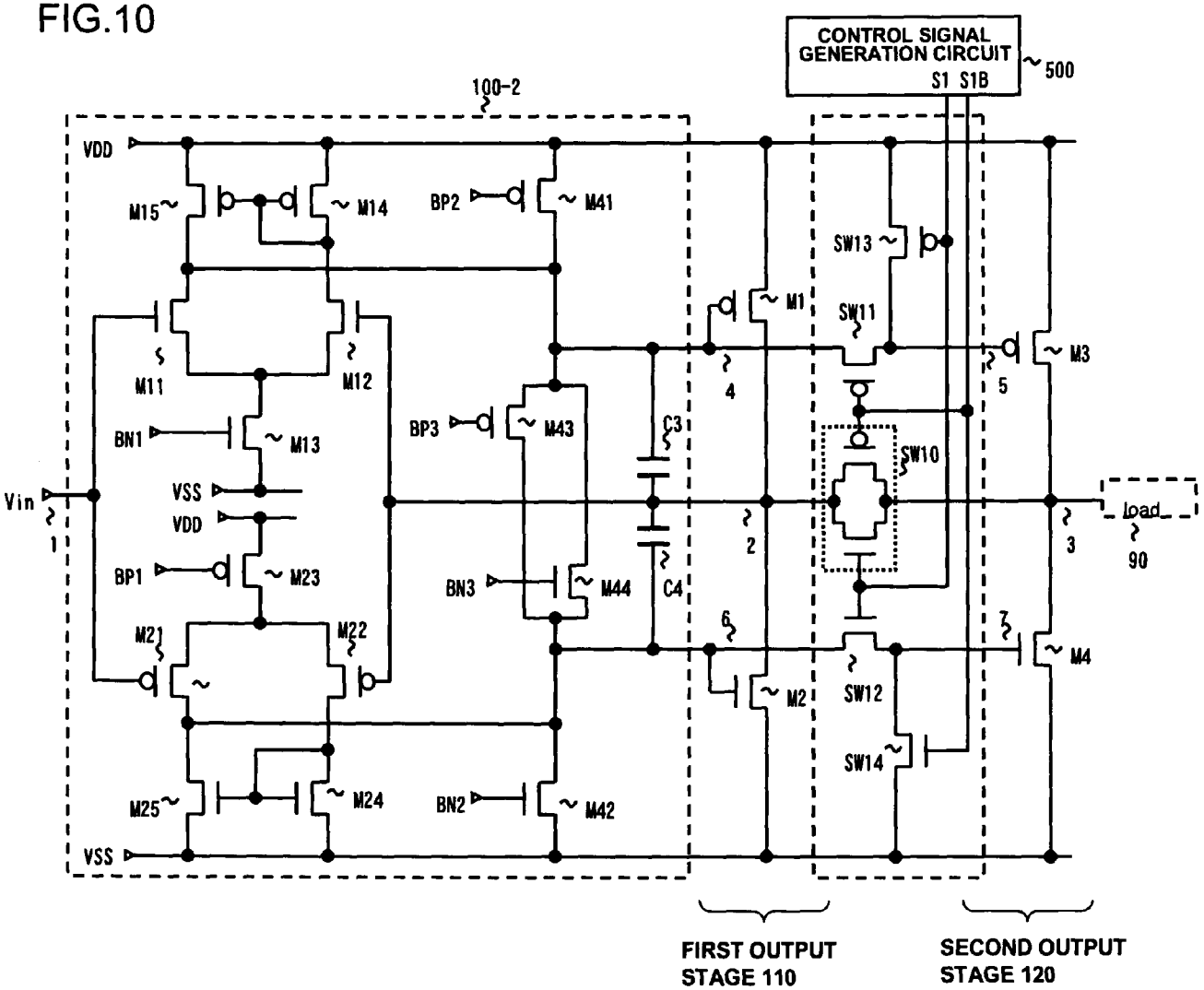
FIG. 10 is a diagram showing a configuration of an eighth exemplary embodiment of the present invention.

FIG. 10 is a diagram showing a configuration in an eighth exemplary embodiment of the present invention. FIG. 10 shows an example of a configuration showing each of the output amplifier circuit in FIG. 2A, the output amplifier circuits 701 and 702 in FIG. 5, and the output amplifier circuits 703 and 704 in FIG. 7. The configuration is set to a Rail-to-Rail amplifier configuration. With respect to a differential stage 100-2, FIG. 1A and a description of FIG. 1A in Patent Document 5 (JP Patent Kokai Publication JP-P-2005-124120A) is referred to.

Referring to FIG. 10, the differential stage 100-2 includes an nMOS transistor M13 (current source) having a source thereof connected to a power supply VSS and nMOS transistors M11 and M12 (nMOS differential pair) with a commonly connected source thereof connected to a drain of the nMOS transistor M13; and pMOS transistor M14 and M15 (load circuit) having sources thereof connected to a power supply VDD and gates thereof connected in common, and drains thereof connected to drains of nMOS transistors M12 and M11, respectively. A gate of the nMOS transistor M13 receives a bias voltage BN1. A drain and a gate of the pMOS transistor M14 are connected. The pMOS transistors M14 and M15 form a current mirror, thereby forming an active load circuit. This differential amplifier is also referred to as an "N receiving differential amplifier".

The differential stage 100-2 includes a pMOS transistor M23 (current source) having a source thereof connected to the power supply VDD, pMOS transistors M21 and M22 (pMOS differential pair) with a commonly connected source thereof connected to a drain of the pMOS transistor 23, and nMOS transistors M24 and M25 (load circuit) having sources thereof connected to the power supply VSS, gates thereof connected in common, and drains thereof respectively connected to drains of the pMOS transistors M22 and M21. A gate of the pMOS transistor M23 receives a bias voltage BP1. A drain and a gate of the nMOS transistor M24 are connected. The nMOS transistors M24 and M25 form a current mirror, thereby forming an active load circuit. This differential amplifier is also referred to as a "P receiving differential amplifier".

Gates of the transistors M11 and M21 are connected in common to an input terminal 1. Gates of the transistors M11 and M22 are connected in common to an output node 2 of a first output stage 110.

The differential stage 100-2 further includes a pMOS transistor M41 having a source thereof connected to the power supply VDD and a drain thereof connected to a drain of the pMOS transistor M15 (nMOS differential pair output), an nMOS transistor M42 having a source thereof connected to a power supply VSS and a drain thereof connected to a drain of the nMOS transistor M25 (pMOS differential pair output), and a pMOS transistor M43 and an nMOS transistor MN44 (floating current source) connected between the drains of the pMOS transistors M41 and M42. A gate of the pMOS transistor M41 receives a bias voltage BP2. A gate of the nMOS transistor M42 receives a bias voltage BN2. Gates of the pMOS transistor M43 and the nMOS transistor M44 respectively receive bias voltages BP3 and BN3. An output circuit including a circuit (M41 to M44) is referred to as an AB-class output circuit.

The drain of the pMOS transistor M41 is set to a first output node 4 of the differential stage 100-2. The drain of the nMOS transistor M42 is set to a second output node 6 of the differential stage 100-2. The first output node 4 and the second output node 6 in the differential stage 100-2 are also an output of the nMOS differential pair (M11, M12) and an output of the pMOS differential pair (M21, M22), respectively. A first output 4 and a second output 6 in the differential stage 100-2 operate in a direction opposite to that of a voltage change of an input voltage Vin when the voltage of the input voltage Vin is changed.

A first output stage 110 includes a pMOS transistor M1 and an nMOS transistor M2. A second output stage 120 includes a pMOS transistor M3 and an nMOS transistor M4. A capacitance C3 is connected between the output node 2 of the first output stage 110 and the first output 4 of the differential stage 100-2. A capacitance C4 is connected between the output node 2 of the first output stage 110 and the second output 6 of the differential stage 100-2. The capacitances C3 and C4 perform phase compensating operations on the first output stage 110 and the second output stage 120, respectively.

A switch SW10 between the output node 2 of the first output stage 110 and an output 3 of the second output stage 120 includes a CMOS transfer gate. A control signal S1 is supplied to the gate of the nMOS transistor, and a complementary signal S1B of the control signal S1 is supplied to the pMOS transistor. When the control signal S1 is High, the switch SW10 is turned on. The signals S1 and S1B are generated by a control signal generation circuit 500 and are control signals that control the switch SW10 and switches SW11 to SW14.

The switch SW11 between the output 4 of the differential stage 100-1 and a gate 5 of the transistor M3 of the second output stage 120 includes a pMOS transistor. To a gate of the switch SW11, the control signal S1B is connected.

The switch SW12 between the second output 6 of the differential stage 100-1 and a gate 7 of the transistor M4 of the second output stage 120 includes an nMOS transistor. To a gate of the switch SW12, the control signal S1 is connected.

Since on/off control over the switches SW10, SW11, SW12, SW13, and SW14 in FIG. 10 is as shown in FIG. 2B for the output amplifier circuit in FIG. 2A, FIGS. 6A and 6B for the output amplifier circuits 701 and 702 in FIG. 5, and FIGS. 8A and 8B for the output amplifier circuits 703 and 704 in FIG. 7, a description of the on/off control will be omitted.

According to these exemplary embodiments (exemplary embodiments 7 and 8) in FIGS. 9 and 10, in a first voltage range of an input signal voltage Vin on the side of the power supply VSS between VSS and VSS+Vgs1 (gate-to-source voltage of the transistor M11 or M12)+Vds1 (drain-to-source voltage in the saturation region of the current source transistor M13), the differential pair of the pMOS transistors M21 and M22 operates. In a second voltage range of the input signal voltage Vin on the side of the power supply VDD between VDD and VDD−Vgs2 (gate-to-source voltage of the transistor M21 or M22)+Vds2 (drain-to-source voltage in the saturation region of the current source transistor M23), the differential pair of the nMOS transistors M11 and M12 operates. In a range between the first and second voltage ranges, the differential pair of the nMOS transistors M11 and M12 and the differential pair of the pMOS transistors M21 and M22 operate, so that an input voltage between the power supply terminal VDD and the ground terminal VSS can be thereby accommodated.

Ninth Exemplary Embodiment

Figure 11:
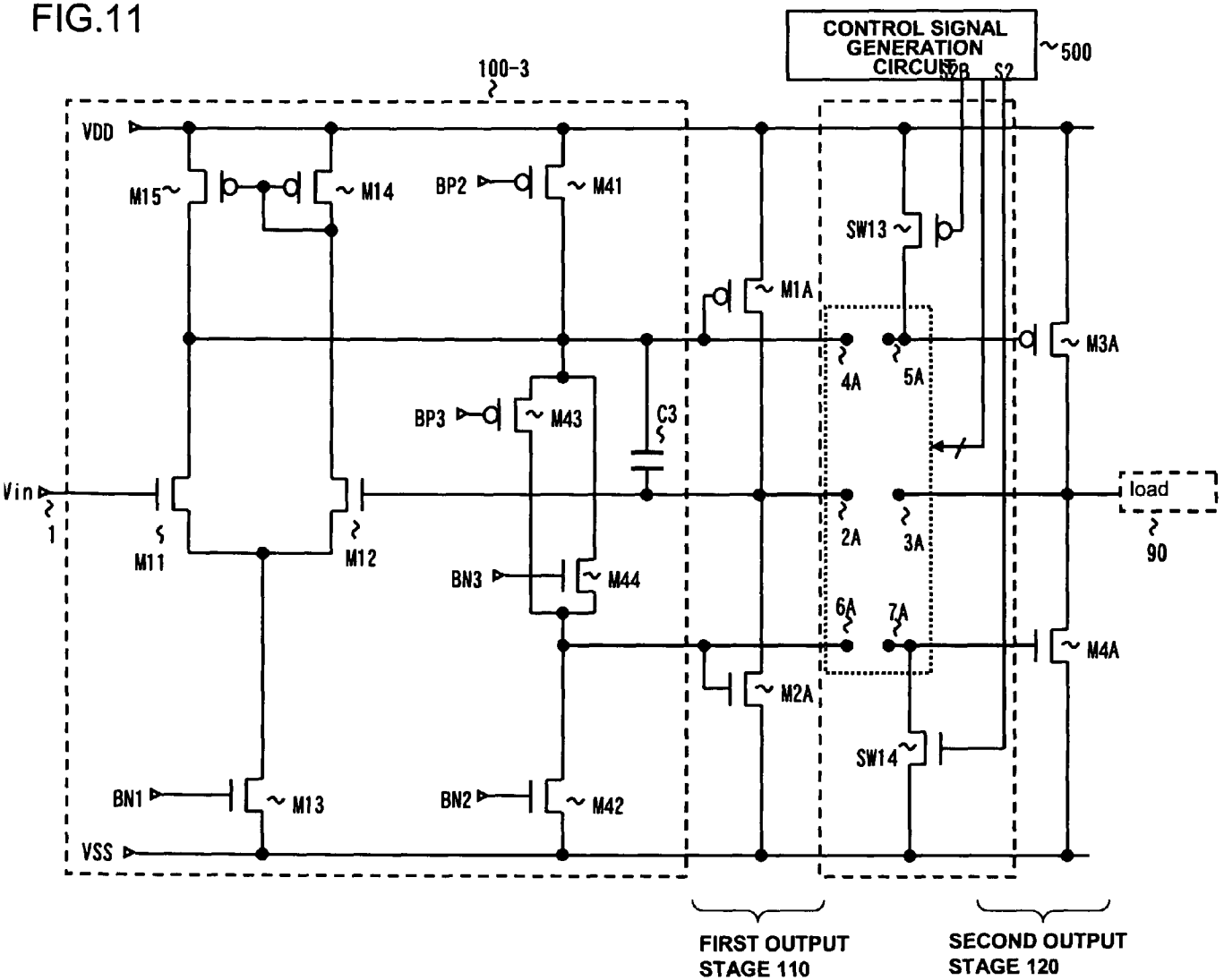
FIG. 11 is a diagram showing a configuration of a ninth exemplary embodiment of the present invention.

FIG. 11 is a diagram showing a configuration of a ninth exemplary embodiment of the present invention. FIG. 11 shows an example of a configuration of the output amplifier circuit 703 in FIG. 7. Referring to FIG. 11, in a differential stage 100-3 in this exemplary embodiment, the pMOS differential pair (M21, M22), current source (M23), load (M24, M25), and the capacitance C4 in FIG. 10 are eliminated, thereby forming the configuration of one of the two polarities. That is, the differential stage 100-3 includes an nMOS current source M13, an nMOS differential pair (M11, M12), a pMOS load circuit (M14, M15), a pMOS transistor M41, a floating current source (M43, M44), and an nMOS transistor M42. The pMOS transistor M41 is connected between a power supply terminal VDD and an output 4A of the differential pair, and is biased by a predetermined voltage BP2. One end of the floating current source (M43, M44) is connected to the output 4A of the nMOS differential pair. The nMOS transistor M42 is connected between the other end of the floating current source (M43, M44) and a power supply terminal VSS, and is biased by a predetermined voltage BN2. The one end and the other end of the floating current source (M43, M44) are respectively set to a first output (4A) and a second output (6A) of the differential stage 100-3. A capacitance C3 is connected between an output node 2A of a first output stage 110 and the first output 4A of the differential stage 100-3.

The first output stage 110 includes a pMOS transistor M1A and an nMOS transistor M2A. A second output stage 120 includes a pMOS transistor M3A and an nMOS transistor M4A. A switch SW14 between a gate 7A of the transistor M4A in the second output stage 120 and a power supply VSS includes an nMOS transistor. A control signal S2 is connected to the gate of the nMOS transistor that constitutes the switch SW14. A switch SW13 between a gate 5A of the transistor M3 and a power supply VDD includes a pMOS transistor. A complementary signal S2B of the control signal S2 is connected to the gate of the pMOS transistor that constitutes the switch SW13. The signals S2 and S2B are generated by a control signal generation circuit 500.

Referring to FIG. 11, as shown in FIG. 7, by the first through third switching circuits 400-1 to 400-3, the output node 2A of the first output stage 110 and the first output 4A and the second output 6A of the differential stage 100-3 are respectively straight connected to an output node 3A of the second output stage, and the gate 5A of the transistor M3A and the gate 7A of the transistor M4A in the second output stage in the output amplifier circuit 703. Alternatively, the output node 2A of the first output stage 110 and the first output 4A and the second output 6A of the differential stage 100-3 are respectively cross-connected to an output node 3B of a second output stage, and a gate 5B of a transistor M3B and a gate 7B of a transistor M4B in the second output stage in an output amplifier circuit 704. The first through third switching circuits 400-1 to 400-3 are also controlled by a control signal (control signal other than the control signals S2 and S2B) generated by the control signal generation circuit 500.

When Rail-to-Rail driving is performed in the configuration in FIG. 7, the configuration in FIG. 11 is employed as the output amplifier circuit 703. As the output amplifier circuit 704 in FIG. 7, the nMOS differential stage in FIG. 11 is changed to a pMOS differential stage. That is, as the output amplifier circuit 704, a configuration obtained by eliminating the nMOS differential stage (M11, M12), current source (M 13), load circuit (M14, M15), and a capacitance C3 from the configuration in FIG. 10 is employed.

Tenth Exemplary Embodiment

Figure 12:
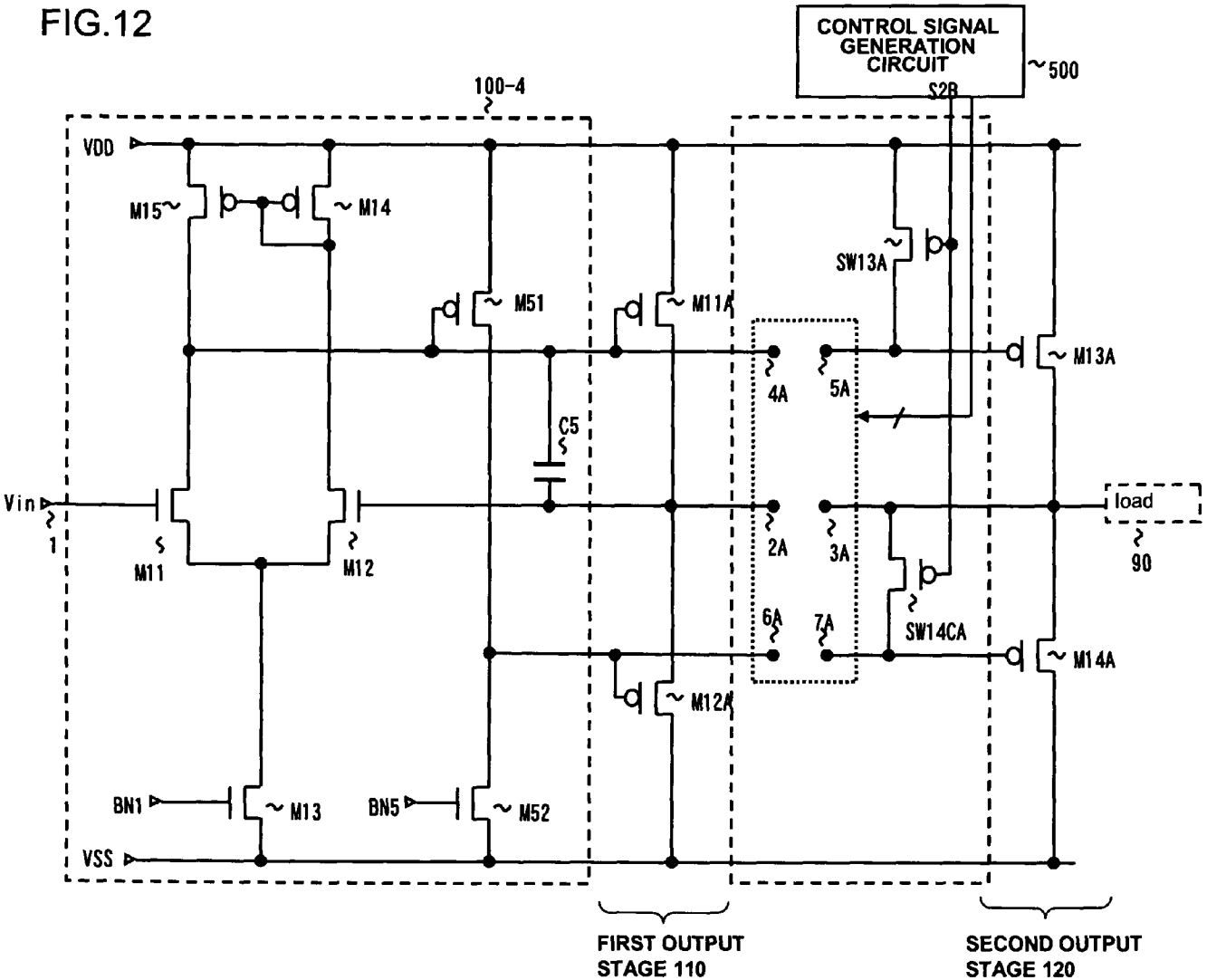
FIG. 12 is a diagram showing a configuration of a tenth exemplary embodiment of the present invention.

FIG. 12 is a diagram showing a configuration of a tenth exemplary embodiment of the present invention. FIG. 12 shows an output amplifier circuit including differential pairs of one of the two polarities, and a first output stage 110 and a second output stage 120 each of which includes charging and discharging elements formed of transistors of a same conductivity type. This exemplary embodiment in FIG. 12 shows a configuration example of the output amplifier circuit 703 in FIG. 7, which is different from that in FIG. 11.

Referring to FIG. 12, a differential stage 100-4 includes an nMOS current source M13, an nMOS differential pair (M11, M12), a pMOS load circuit (M14, M15), a pMOS transistor M51 having a source thereof connected to a power supply terminal VDD and a gate thereof connected to an output 4A of the nMOS differential pair, and an nMOS transistor M52 connected between a drain of the pMOS transistor M51 and a power supply terminal VSS and biased by a predetermined voltage BN5. The output 4A of the nMOS differential pair and a connection node between the transistors M51 and M52 are respectively set to a first output (4A) and a second output (6A) of the differential stage 100-4. In the differential stage 100-4, the first output 4A operates in a direction opposite to that of a voltage change of an input voltage Vin when the voltage of the input voltage Vin is changed. The second output 6A in the differential stage 100-4 operates in a same direction as that of the voltage change of the input voltage Vin. A capacitance C5 is connected an output node 2A of the first output stage 110 and the first output 4A of the differential stage 100-4.

The first output stage 110 includes pMOS transistors M11A and M12A. The second output stage 120 includes pMOS transistors M13A and M14A.

A switch SW13A is connected between a gate 5A of the transistor M13A of the second output stage 120 and a power supply VDD. A switch SW14CA is connected between a gate 7A of the transistor M14A and an output node 3A of the second output stage 120. Each of the switches SW13A and SW14CA includes a pMOS transistor. A control signal S2B is connected to each of gates of the switches SW13A and SW14CA. The signal S2B is generated by a control signal generation circuit 500.

Referring FIG. 12, as shown in FIG. 7, by the first through third switching circuits 400-1 to 400-3, the output node 2A of the first output stage 110 and the first output 4A and the second output 6A of the differential stage 100-4 are respectively straight connected to the output node 3A, gate 5A of the transistor M13A, and gate 7A of the transistor M14A in the second output stage in the output amplifier circuit 703. Alternatively, the output node 2A of the first output stage 110 and the first output 4A and the second output 6A of the differential stage 100-4 are respectively cross-connected to an output node 3B, a gate 5B of a transistor M13B, and a gate 7B of a transistor M14B in a second output stage in an output amplifier circuit 704.

The first through third switching circuits 400-1 to 400-3 are also controlled by a control signal (control signal other than the control signal S2B) generated by the control signal generation circuit 500.

When Rail-to-Rail driving is performed in the configuration in FIG. 7, the configuration in FIG. 12 is employed as the output amplifier circuit 703. As the output amplifier circuit 704 in FIG. 7, the nMOS differential stage in FIG. 12 is changed to a pMOS differential stage. That is, the output amplifier circuit 704 obtained by forming the output amplifier 703 in FIG. 12 using transistors of the opposite conductivity type is employed.

In the exemplary embodiments (ninth and tenth exemplary embodiments) in FIGS. 11 and 12, the differential stage 100 is the nMOS differential stage. Thus, the output amplifier circuit cannot normally operate in a first voltage range of an input signal voltage Vin between VSS and VSS+Vgs1 (gate-to-source voltage of the transistor M11 or M12)+Vds1 (drain-to-source voltage in the saturation region of the current source transistor M13). However, by combining the differential stage 100 with an output amplifier circuit of a pMOS differential stage to cause the resulting output amplifier circuits to respectively perform driving as the output amplifier circuits 703 and 704 in FIG. 7, Rail-to-Rail driving becomes possible.

Eleventh Exemplary Embodiment

Figure 13:
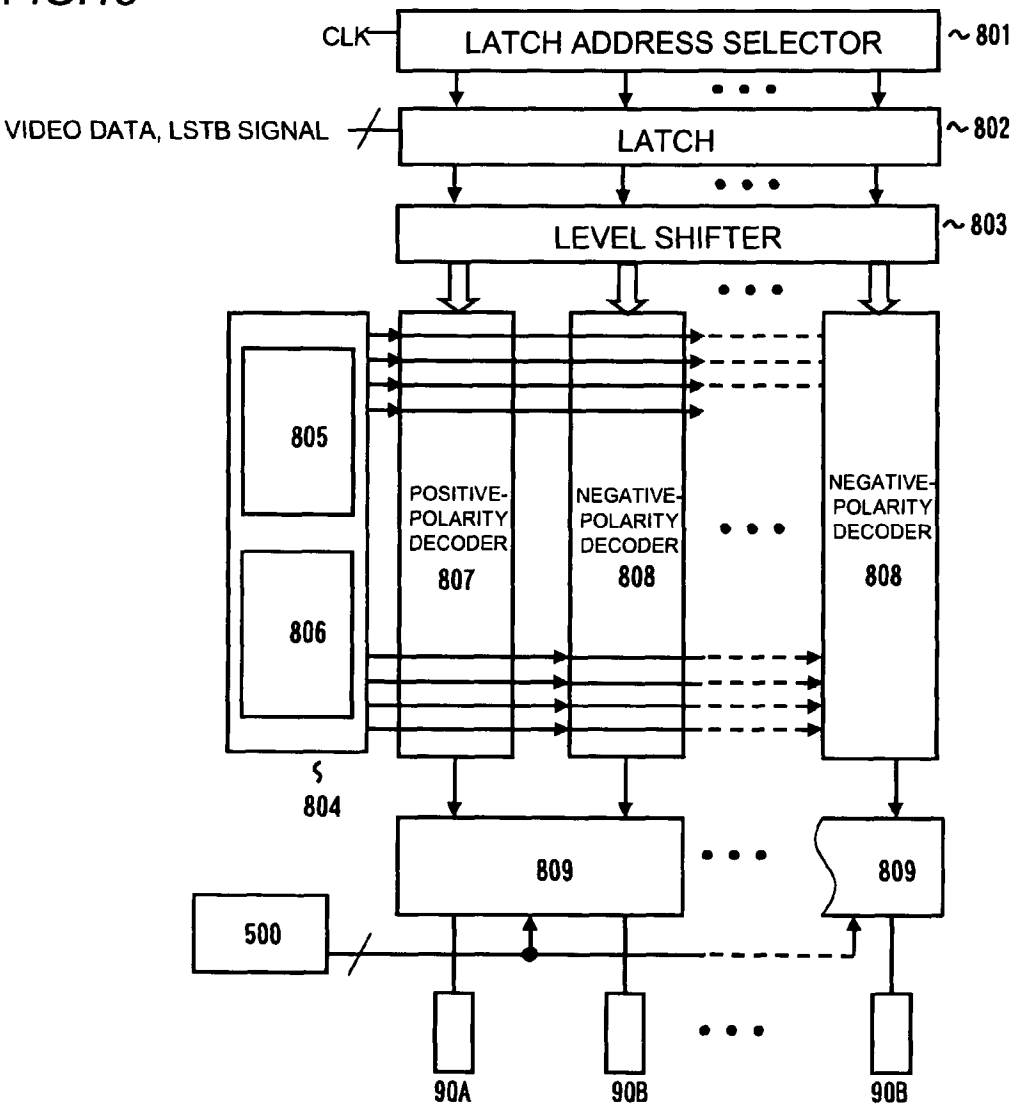
FIG. 13 is a diagram showing a configuration of an eleventh exemplary embodiment of the present invention.

FIG. 13 is a diagram showing a configuration of a data driver including the output amplifier circuits described above and shows a main section of the data driver in the form of blocks.

Referring to FIG. 13, this data driver includes a latch address selector 801, a latch 802, a level shifter 803, a reference voltage generation circuit 804, positive-polarity decoders 807, negative-polarity decoders 808, output circuits 809 each of which receives a polarity signal from a corresponding one of the positive-polarity decoders 807 and a negative-polarity signal from a corresponding one of negative-polarity decoders 808, a control signal generation circuit 500, and loads (data lines) 90A and 90B to be driven by the output circuits 809. Each of the output circuits 809 includes the input switching circuit 300 and the output amplifier circuits 701 and 702 described with reference to FIG. 5 or the output amplifier circuits 703 and 704 described with reference to FIG. 7.

The latch address selector 801 determines a data latch timing, based on a clock signal CLK. The latch 802 latches video digital data, based on the timing determined by the latch address selector 801, and outputs the data to the decoders (positive-polarity decoders and the negative-polarity decoders) in unison through the level shifter 803 according to a timing of a signal LSTB. Each of the latch address selector 801 and the latch 802 is a logic circuit, and is generally configured at a low voltage (of 0V to 3.3V).

The reference voltage generation circuit 804 includes a positive-polarity reference voltage generation circuit 805 and a negative-polarity reference voltage generation circuit 806. To each positive-polarity decoder 807, reference voltages of the positive-polarity reference voltage generation circuit 805 are supplied. The positive-polarity decoder 807 selects a reference voltage corresponding to input data, and outputs the selected reference voltage as a positive-polarity reference voltage (Vin1 in FIG. 5 or 7). To each negative-polarity decoder 808, reference voltages of the negative-polarity reference voltage generation circuit 806 are supplied. The negative-polarity decoder 808 selects a reference voltage corresponding to input data, and outputs the selected reference voltage as a negative-polarity reference voltage (Vin2 in FIG. 5 or 7). Each output amplifier circuit (indicated by reference numeral 701 or 702 in FIG. 5, or 703 or 704 in FIG. 7) of the output circuit 809 receives the reference voltage output from one of the positive-polarity decoder 807 and the negative-polarity decoder 808, operates and amplifies the reference voltage, and supplies an output voltage. As described with reference to FIG. 5 or 7, each output circuit 809 includes the output amplifier circuits 701 and 702 or the output amplifier circuits 703 and 704. The output circuit 809 straightly outputs to the loads 90A and 90B output signals respectively corresponding to the positive signal voltage from the positive-polarity decoder 807 and the negative signal voltage from the negative-polarity decoder 808. Alternatively, the output circuit 809 cross-outputs to the loads 90B and 90A the output signals corresponding to the positive signal voltage from the positive-polarity decoder 807 and the negative signal voltage from the negative-polarity decoder 808, respectively.

The control signal generation circuit 500 is commonly provided for the output circuit 809, and generates a plurality of control signals in accordance with the timing of a signal HSTB. Responsive to the control signals from the control signal generation circuit 500, connection configuration switching in the output amplifier circuits 701 and 702 and the input switching circuit 300 in FIG. 5 or the output amplifier circuits 703 and 704 in FIG. 7 is performed. The signal HSTB is usually corresponds to the signal LSTB supplied to the latch 802.

In the data driver in FIG. 13, no output switch is provided between the output amplifier circuit 809 and the (data line) load. Thus, even for a large-capacitance data line load, high-speed driving and reduction of power dissipation and heat generation can be implemented.

Twelfth Exemplary Embodiment

FIG. 19 is a diagram showing a configuration of a twelfth exemplary embodiment of the present invention. This exemplary embodiment shows an output amplifier circuit that implements an operation similar to that in the fourth exemplary embodiment shown in FIGS. 4A and 4B. Referring to FIGS. 4A and 4B, in the time interval T1, the first output stage 110 operates as the sub-amplifier that drives the internal elements such as the phase compensation capacitance to the state corresponding to the input voltage Vin, and the second output stage 120 is deactivated. In the time interval T2, the second output stage 120 operates as the main amplifier that substantially drives the load, and the first output stage 110 is deactivated.

Figure 19A:
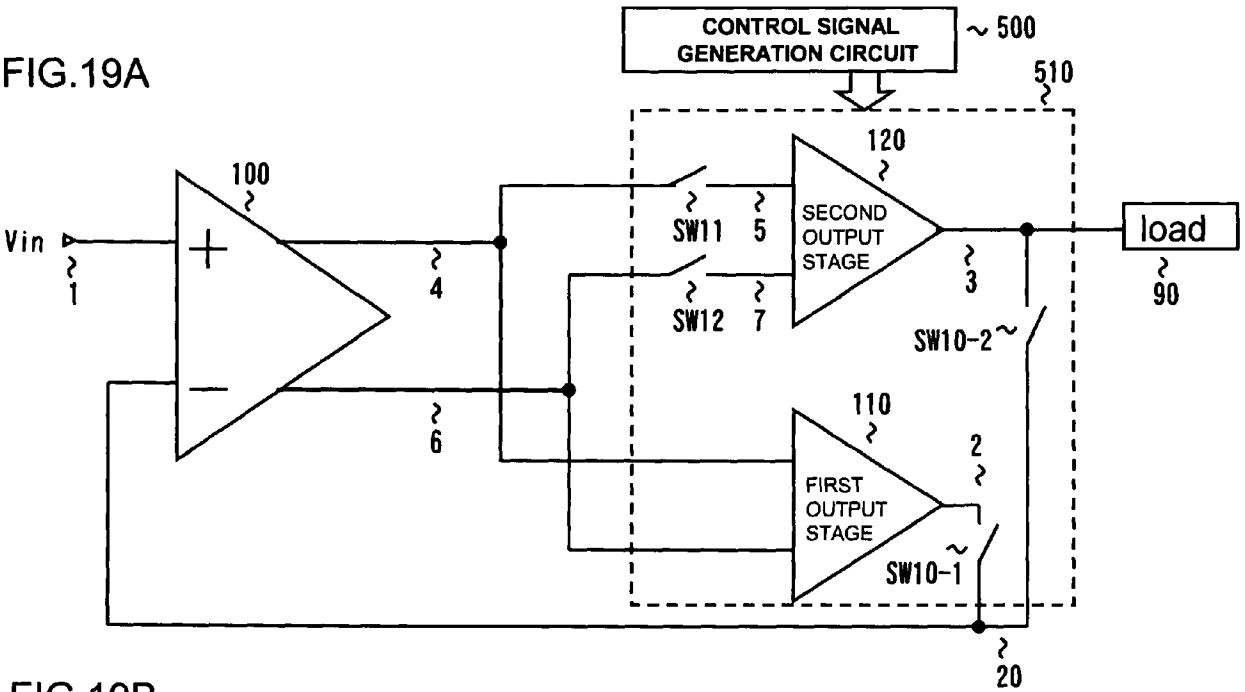
FIGS. 19A and 19B are diagrams respectively showing a configuration and control in twelfth exemplary embodiment of the present invention.

In this exemplary embodiment, in an output amplifier circuit in FIG. 19A, the switch SW10 between the output node 2 of the first output stage 110 and the output node 3 of the second output stage 120 in FIG. 1A is eliminated. Then, a switch SW10-1 is inserted between an inverting input (20) to the differential stage 100 and the output node 2 of the first output stage 110 and a switch SW10-2 is inserted between the inverting input (20) of the differential stage 100 and the output node 3 of the second output stage 120.

Figure 19B:
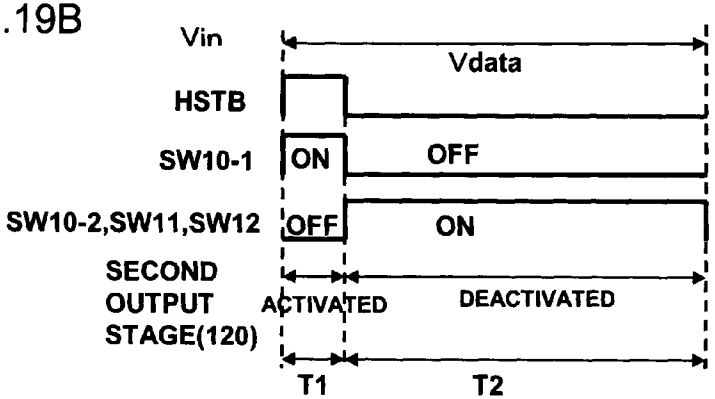

Referring to FIG. 19B, same on/off control as that over the switch SW10 in FIG. 1 is performed on the switch SW10-2, and on/off control that is opposite to that over the switch SW10-2 is performed on the switch SW10-1. That is, in a time interval T1, the output node 2 of the first output stage 110 is feedback connected to the inverting input (20) to the differential stage 100, and the first output stage 110 operates as a sub-amplifier that drives internal elements such as a phase compensation capacitor to a state corresponding to an input voltage Vin. In this case, the second output stage 120 is deactivated. In a time interval T2, the output node 3 of the second output stage 120 is feedback connected to the inverting input (20) to the differential stage 100, and the output stage 120 operates as a main amplifier that substantially drives a load. In this case, the output node 2 of the first output stage 110 is disconnected from the inverting input (20) to the differential stage 100, and does not contribute to driving a load 90. The first output stage 110 is substantially brought into a state similar to being deactivated.

A change of the switches SW10-1 and SW10-2 from the switch SW10 can be applied to all of the output amplifier circuits of the present invention, and the effect similar to that in FIGS. 4A and 4B can be implemented. In this case, the phase compensation capacitance is connected such that a phase compensating operation is performed on both of the first output stage 110 and the second output stage 120. Specifically, in the case of FIGS. 9 and 10, for example, the switch SW10-1 is inserted between inverting inputs of the differential pairs (common gate of the transistors M12 and M22) and the output node 2 of the first output stage 110. Then, connection of first terminals of the capacitances (C1, C2, C3, and C4) is changed from the output node 2 to the inverting inputs of the differential pairs.

Each disclosure of Patent Documents 1 through 5 described above is incorporated herein by reference. Modifications and adjustments of the exemplary embodiment and the exemplary embodiments are possible within the scope of the overall disclosure (including claims) of the present invention, and based on the basic technical concept of the invention. Various combinations and selections of various disclosed elements are possible within the scope of the claims of the present invention. That is, the present invention of course includes various variations and modifications that could be made by those skilled in the art according to the overall disclosure including the claims and the basic technical concept. It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. An output amplifier circuit comprising:

a differential stage receiving an input signal at a non-inverting input thereof;

a first output stage having first and second inputs electrically connected to first and second outputs of the differential stage, respectively;

a second output stage having an output thereof electrically connected to a load to be driven; and a connection control circuit performing switching between:

a first connection configuration in which the first and second outputs of the differential stage are electrically disconnected from first and second inputs of the second output stage, an output of the first output stage is electrically disconnected from an output of the second output stage, and the output of the first output stage is electrically connected to an inverting input of the differential stage; and a second connection configuration in which the first and second outputs of the differential stage are electrically connected to the first and second inputs of the second output stage, respectively, and at least the output of the second output stage out of the first and second output stages is electrically connected to the inverting input of the differential stage.

2. The output amplifier circuit according to claim 1, wherein in the first connection configuration, the connection control circuit deactivates the second output stage; and in the second connection configuration, the connection control circuit activates the second output stage.

3. The output amplifier circuit according to claim 1, wherein a data period, in which the input signal is received and then the load is driven, includes:

a first time interval from a starting point of time of the data period; and a second time interval after the first time interval;

in the first time interval, the first connection configuration being employed, and in the second time interval, the second connection configuration being employed.

4. The output amplifier circuit according to claim 1, wherein in the first connection configuration, the inverting input of the differential stage is electrically connected to the output of the first output stage; and in the second connection configuration, the output of the first output stage is electrically connected to the output of the second output stage, and the output of the first output stage and the output of the second output stage are electrically connected in common to the inverting input of the differential stage.

5. The output amplifier circuit according to claim 1, wherein in the first connection configuration, the inverting input of the differential stage is electrically connected to the output of the first output stage, and the inverting input of the differential stage is electrically disconnected from the output of the second output stage; and in the second connection configuration, the inverting input of the differential stage is electrically connected to the output of the second output stage, and the inverting input of the differential stage is electrically disconnected from the output of the first output stage.

6. The output amplifier circuit according to claim 5, wherein the connection control circuit comprises:

a first switch provided between the first output of the differential stage and the first input of the second output stage;

a second switch provided between the second output of the differential stage and the second input of the second output stage;

a third switch provided between the output of the first output stage and the inverting input of the differential stage; and a fourth switch provided between the output of the second output stage and the inverting input of the differential stage.

7. The output amplifier circuit according to claim 6, wherein in the first connection configuration, the first, second, and fourth switches are turned off, and the third switch is turned on; and in the second connection configuration, the first, second, and fourth switches are turned on, and the third switch is turned off.

8. The output amplifier circuit according to claim 1, wherein the connection control circuit comprises:

a first switch provided between the first output of the differential stage and the first input of the second output stage;

a second switch provided between the second output of the differential stage and the second input of the second output stage; and a third switch provided between the output of the first output stage and the output of the second output stage.

9. The output amplifier circuit according to claim 8, wherein in the first connection configuration, the first, second and third switches are turned off; and in the second connection configuration, the first, second and third switches are turned on.

10. The output amplifier circuit according to claim 1, wherein the first output stage comprises:

first and second transistors arranged in series between a first power supply terminal that supplies a first power supply potential and a second power supply terminal that supplies a second power supply potential, control terminals of the first and second transistors being electrically connected to the first and second inputs of the first output stage, respectively and electrically connected respectively to first and second outputs of the differential stage; wherein the second output stage comprises:

third and fourth transistors arranged in series between the first power supply terminal and the second power supply terminal, control terminals of the third and fourth transistors respectively comprising first and second inputs of the second output stage;

a connection node between the first and second transistors comprising an output node of the first output stage;

a connection node between the third and fourth transistors comprising an output node of the second output stage; and wherein the connection control circuit comprises:

a first switch provided between the control terminal of the first transistor and the control terminal of the third transistor;

a second switch provided between the control terminal of the second transistor and the control terminal of the fourth transistor;

a third switch provided between the output node of the first output stage and the output node of the second output stage;

a fourth switch provided between the control terminal of the third transistor and one of the first and second power supply terminals that applies a voltage to the control terminal of the third transistor to turn off the third transistor; and a fifth switch provided between the control terminal of the fourth transistor and one of the first and second power supply terminals that applies a voltage to the control terminal of the fourth transistor, to turn off the fourth transistor.

11. The output amplifier circuit according to claim 10, wherein in the first connection configuration, the first, second and third switches are turned off, and both of the fourth and fifth switches are turned on, and in the second connection configuration, all of the first, second and third switches are turned on, and both of the fourth and fifth switches are turned off.

12. The output amplifier circuit according to claim 10, wherein dimensions of the first and second transistors in the first output stage are set to be not more than dimensions of the third and fourth transistors in the second output stage.

13. The output amplifier circuit according to claim 10, wherein the control connection circuit further comprises:

a sixth switch provided between the control terminal of the first transistor and a first output of the differential stage;

a seventh switch provided between the control terminal of the first transistor and one of the first and second power supply terminals that applies a voltage to the control terminal of the first transistor to turn off the first transistor;

an eighth switch provided between the control terminal of the second transistor and a second output of the differential stage; and a ninth switch provided between the control terminal of the second transistor and one of the first and second power supply terminals that applies a voltage to the control terminal of the second transistor to turn off the second transistor.

14. The output amplifier circuit according to claim 13, wherein in the first connection configuration, the sixth and eighth switches are turned on and the seventh and ninth switches are turned off, and in the second connection configuration, the sixth and eighth switches are turned off and the seventh and ninth switches are turned on.

15. The output amplifier circuit according to claim 1, wherein the first output stage comprises first and second transistors arranged in series between a first power supply terminal that supplies a first power supply potential and a second power supply terminal that supplies a second power supply potential, control terminals of the first and second transistors being respectively electrically connected to the first and second inputs of the first output stage and being electrically connected to the first and second outputs of the differential stage; wherein the second output stage comprises third and fourth transistors arranged in series between the first power supply terminal and the second power supply terminal, control terminals of the third and fourth transistors electrically connected to the first and second inputs of the second output stage, respectively, a connection node between the first and second transistors constituting an output node of the first output stage, a connection node between the third and fourth transistors constituting an output node of the second output stage, and wherein the connection control circuit comprises:

a first switch provided between a control terminal of the first transistor and a control terminal of the third transistor;

a second switch provided between a control terminal of the second transistor and a control terminal of the fourth transistor;

a third switch provided between the output node of the first output stage and the output node of the second output stage;

a fourth switch provided between the control terminal of the third transistor and one of the first and second power supply terminals that applies a voltage to the control terminal of the third transistor to turn off the third transistor; and a fifth switch provided between the control terminal of the fourth transistor and a first terminal of the fourth transistor electrically connected to the output node of the second output stage.

16. The output amplifier circuit according to claim 1, wherein the connection control circuit deactivates the first output stage in the second connection configuration.

17. The output amplifier circuit according to claim 1, wherein the differential stage comprises:

a first differential pair of a first conductivity type and a first current source that supplies a driving current to the first differential pair;

a second differential pair of a second conductivity type and a second current source that supplies a driving current to the second differential pair, non-inverting inputs of the first and the second differential pairs being coupled together, inverting inputs of the first and second differential pairs being coupled together;

a first cascode current mirror circuit electrically connected to a differential output pair of the first differential pair;

first and second floating current sources having one ends thereof electrically connected to first and second terminals of the first cascode current mirror circuit, respectively; and a second cascode current mirror circuit electrically connected to a differential output pair of the second differential pair, first and second terminals of the second cascode current mirror circuit being electrically connected to the other ends of the first and second floating current sources, respectively; and the first terminals of the first and second cascode current mirror circuits are set to the first and second outputs of the differential stage.

18. The output amplifier circuit according to claim 1, wherein the differential stage comprises:

a first differential pair of a first conductivity type and a second differential pair of a second conductivity type, the first differential pair being driven by a first current source, the second differential pair being driven by a second current source, output pairs of the first differential pair and the second differential pair being respectively electrically connected to first and second load circuits, the first input of the first differential pair and the first input of the second differential pairs being electrically connected, the second inputs of the first and second differential pairs being electrically connected;

a transistor of the second conductivity type arranged between the first power supply terminal and an output of the first differential pair and biased by a predetermined voltage;

a floating current source connected between the output of the first differential pair and an output of the second differential pair; and a transistor of the first conductivity type arranged between the second power supply terminal and the output of the second differential pair and biased by a predetermined voltage; and the output of the first differential pair and the output of the second differential pair are respectively set to the first and second outputs of the differential stage.

19. The output amplifier circuit according to claim 1, wherein the differential stage comprises:

a differential pair and a current source that supplies a driving current to the differential pair, the differential pair having an output pair thereof electrically connected to a load circuit;

a transistor arranged between the first power supply terminal and an output of the differential pair and biased by a predetermined voltage;

a floating current source having one end thereof electrically connected to the output of the differential pair; and another transistor arranged between the other end of the floating current source and the second power supply terminal; and the one and other ends of the floating current source being electrically connected to the first and second outputs of the differential stage, respectively.

20. The output amplifier circuit according to claim 1, wherein the first output stage and the second output stage share a phase compensation capacitor.

21. An output circuit comprising:

a first input terminal to which a positive-polarity signal is supplied;

a second input terminal to which a negative-polarity signal is supplied;

first and second output terminals;

an input switching circuit that performs switching between the positive-polarity signal being output from the first output terminal and the negative-polarity signal being output from the second output terminal; and the negative-polarity signal being output from the first output terminal and the positive-polarity signal being output from the second output terminal;

a first output amplifier circuit electrically connected to the first output terminal of the input switching circuit to drive a first load; and a second output amplifier circuit electrically connected to the second output terminal of the input switching circuit to drive a second load;

each of the first and second output amplifier circuits comprising the output amplifier circuit as set forth in claim 1.

22. The output circuit according to claim 21, wherein a load driving time interval in which the first and second output amplifier circuits receive the positive-polarity signal and the negative-polarity signal and drive the first and second loads, respectively, comprises a plurality of the data periods, each of the data periods including:

a first time interval from a starting point of time of the data period; and a second time interval after the first time interval;

in the first time interval, in each of the first and second output amplifier circuits, the first connection configuration being employed, and the second output stage being deactivated, and in the second time interval, in each of the first and second output amplifier circuits, the second connection configuration being employed, and the second output stage being activated.

23. The output circuit according to claim 21, wherein a driving time interval in which the first and second output amplifier circuits receives the positive-polarity signal and the negative-polarity signal and drives the first and second loads, respectively, comprises:

a plurality of the data periods in which the first and second loads are respectively driven by positive polarity and negative polarity, and a plurality of the data periods in which the first and second loads are respectively driven by the negative polarity and the positive polarity;

at least a first data period after switching of the polarities of the first and second loads has been performed including:

a first time interval from a starting point of time of the data period; and a second time interval after the first time interval;

in the first time interval, in each of the first and second output amplifier circuits, the first connection configuration being employed, and the second output stage being deactivated, and in the second time interval, in each of the first and second output amplifier circuits, the second connection configuration being employed, and the second output stage being activated.

24. The output circuit according to claim 23, wherein in one data period in which the polarities of the first and second loads are the same as those in a data period immediately preceding to the one data period, each of the first and second output amplifier circuits is set to the second connection configuration, and the second output stage is activated.

25. A data driver that drives, as first and second loads, first and second data lines of a display device, the display device comprising a plurality of unit pixels, each of the unit pixels including:

a pixel switch; and a display element, at an intersection between the data line and a scan line, wherein the data driver comprises, as an output circuit including first and second output amplifier circuits that receive a positive-polarity signal from a positive-polarity decoder and a negative-polarity signal from a negative-polarity decoder and drives the first and second loads, the output circuit as set forth in claim 21.

26. The data driver according to claim 25, comprising:

at least one control signal generation circuit that supplies a control signal that is for controlling switching of the connection configurations to a plurality of the output circuits.

27. An output circuit comprising:

a first output amplifier circuit receiving a positive-polarity signal as an input, the first output amplifier driving a first load or a second load by positive polarity;

a second output amplifier circuit receiving a negative-polarity signal as an input, the second output amplifier circuit driving the second load by negative polarity, when the first output amplifier circuit drives the first load by the positive polarity, the second output amplifier circuit driving the first load by the negative polarity, when the first output amplifier circuit drives the second load by the positive polarity, each of the first and second output amplifier circuits comprising the output amplifier circuit as set forth in claim 1; and a switching circuit that switches:

connection between respective outputs of the differential stages of the first and second output amplifier circuits and respective inputs of the second output stages of the first and second output amplifier circuits to either straight connection or cross connection, and connection between respective outputs of the second output stages of the first and second output amplifier circuits and respective outputs of the first output stages of the first and second output amplifier circuits to either straight connection or cross connection.

28. A data driver that drives a data line of a display device as a load, the display device comprising a plurality of unit pixels, each of the unit pixels including:

a pixel switch; and a display element, at an intersection between the data line and a scan line, the data driver comprising the output amplifier circuit as set forth in claim 1.

29. The data driver according to claim 28, comprising:

at least one control signal generation circuit that supplies a control signal which is for controlling switching of the connection configurations to a plurality of the output circuits.

30. A display device comprising:

a plurality of data lines extended in parallel to one another in one direction;

a plurality of scan lines extended in parallel to one another in a direction orthogonal to the one direction;

a plurality of pixel electrodes arranged at intersections between the data lines and the scan lines in a matrix form;

a plurality of transistors, each of the transistors having one of a drain and source thereof electrically connected to an associated one of the pixel electrodes and having the other of the drain and source thereof electrically connected to an associated one of the data lines and a gate thereof electrically to an associated one of the scan lines, the transistors being arranged corresponding to the pixel electrodes, respectively;

a gate driver that supplies a scan signal to each of the scan lines; and a data driver that supplies a gray scale signal corresponding to input data to each of the data lines, the data driver as set forth in claim 28.

* * * * *